US008234749B2

(12) United States Patent
Mitchell et al.

(10) Patent No.: US 8,234,749 B2
(45) Date of Patent: Aug. 7, 2012

(54) ORBITAL SCRUBBER WITH STABILIZER ELEMENT

(75) Inventors: Kevin Blaine Mitchell, West Fork, AR (US); James J. Keazer, Rogers, AR (US); Emert R. Whitaker, Siloam Springs, AR (US)

(73) Assignee: Nilfisk-Advance, Inc., Plymouth, MN (US)

( * ) Notice: Subject to any disclaimer, the term of this patent is extended or adjusted under 35 U.S.C. 154(b) by 1256 days.

(21) Appl. No.: 11/927,529

(22) Filed: Oct. 29, 2007
(Under 37 CFR 1.47)

(65) Prior Publication Data

US 2008/0078041 A1 Apr. 3, 2008

Related U.S. Application Data

(63) Continuation-in-part of application No. 10/905,575, filed on Jan. 11, 2005, now abandoned.

(51) Int. Cl.

| | |
|---|---|
| ***A47L 7/00*** | (2006.01) |
| ***A47L 5/34*** | (2006.01) |
| ***A47L 5/00*** | (2006.01) |
| ***A47L 9/04*** | (2006.01) |
| ***E01H 1/08*** | (2006.01) |

(52) U.S. Cl. ..... 15/340.3; 15/320; 15/340.1; 15/340.4; 15/355; 15/371

(58) Field of Classification Search ..... 15/320, 15/340.1, 340.3, 340.4, 355, 371
See application file for complete search history.

(56) References Cited

U.S. PATENT DOCUMENTS

| | | | | |
|---|---|---|---|---|
| 1,067,889 | A | 7/1913 | Trudeau | |
| 1,240,799 | A | 9/1917 | Gray | |
| 1,472,208 | A * | 10/1923 | Dawer | 15/320 |
| 2,514,142 | A | 1/1945 | Reid | |
| 2,558,590 | A | 6/1951 | Smith | |
| 3,121,895 | A | 2/1964 | Burgoon | |
| 3,416,177 | A * | 12/1968 | Young | 15/98 |
| 3,655,444 | A * | 4/1972 | Young | 134/6 |
| RE29,247 | E | 6/1977 | Kilstrom et al. | |
| 4,295,243 | A | 10/1981 | King | |

(Continued)

FOREIGN PATENT DOCUMENTS

| | | |
|---|---|---|
| EP | 0351359 | 1/1990 |

(Continued)

OTHER PUBLICATIONS

Tennant, F a.S.T. Foam Scrubbing Technology, Advertising Handout, 2002, 4 pgs., Tennant Company, 701 North Lilac Drive, Minneapolis, MN, U.S.A.

(Continued)

*Primary Examiner* — Bryan R Muller
(74) *Attorney, Agent, or Firm* — Schwegman, Lundberg & Woessner, P.A.

(57) ABSTRACT

Vibration dampening elements that are made of rubber and/or an elastomer may fail when subjected to vertical and/or horizontal stresses caused by repeated lifting of the cleaning head assembly and/or unintentional bumping of the cleaning head assembly into door frames, walls or other non-movable objects. The present invention includes, among other things, at least one stabilizer element and preferably two stabilizer elements to reduce damage to certain vibration dampening elements caused by vertical and/or horizontal stress. Alternative embodiments of the stabilizer element are also disclosed.

12 Claims, 22 Drawing Sheets

U.S. PATENT DOCUMENTS

| | | | | |
|---|---|---|---|---|
| 4,667,364 | A | 5/1987 | Meili | |
| 4,674,142 | A * | 6/1987 | Meili | 15/49.1 |
| 4,757,566 | A | 7/1988 | Field et al. | |
| 5,355,542 | A * | 10/1994 | Oreck et al. | 15/49.1 |
| 5,369,838 | A * | 12/1994 | Wood et al. | 15/320 |
| 5,383,251 | A | 1/1995 | Whitaker et al. | |
| 5,507,061 | A | 4/1996 | Miyazaki | |
| 5,608,939 | A | 3/1997 | Waldhauser et al. | |
| 6,105,192 | A | 8/2000 | Dieterman et al. | |
| 6,148,475 | A | 11/2000 | Stross | |
| 6,353,964 | B1 | 3/2002 | Andrisin, Jr. et al. | |
| 6,481,515 | B1 | 11/2002 | Kirkpatrick et al. | |
| 6,493,896 | B1 | 12/2002 | Stuchlik et al. | |
| 6,494,772 | B1 | 12/2002 | Barnes et al. | |
| 6,557,207 | B2 * | 5/2003 | Stuchlik | 15/401 |
| 6,585,827 | B2 | 7/2003 | Field et al. | |
| 6,705,332 | B2 | 3/2004 | Field et al. | |
| 6,938,295 | B1 | 9/2005 | Lancaster et al. | |
| 2002/0073494 | A1 | 6/2002 | Stuchlik | |
| 2003/0070252 | A1 | 4/2003 | Pedler et al. | |
| 2004/0040102 | A1 | 3/2004 | Field et al. | |
| 2006/0150362 | A1 | 7/2006 | Mitchel | |

FOREIGN PATENT DOCUMENTS

| | | | |
|---|---|---|---|
| FR | 2657769 | A | 8/1991 |
| GB | 399174 | | 9/1933 |
| GB | 685715 | | 1/1953 |
| GB | 2268393 | | 12/1994 |
| WO | 98/42245 | A | 10/1998 |

OTHER PUBLICATIONS

Tennant Website, F.a.S.T. Foam Scrubbing Technology, Website Advertisement, 2004, 1 pg., Tennant Website.

Clarke, Clarke American Sanders OBS 18 & OBS 18dc Orbital Floor Sanders, Advertisement, 2003, 2 pgs., Clarke, 2100 Hwy. 265, Springdale, AR, U.S.A.

Clarke, Clarke American Sanders Divison of ALTO Operator's Manual OBS-18 OBS 18DC, Manual, 14 pgs., Form No. 70288B, Clarke American Sanders, 2100 Hwy. 265, Springdale, AR, U.S.A.

Clarke, Clarke Parts List for Clarkeamatic Floor Maintainer, Catalog, 1963, 11 pgs., Form No. 215-SP, Clarke Floor Machine Company, Division of Studebaker Corporation, 30 E. Clay Avenue, Muskegan, MI, U.S.A.

Clarke Floor Machine Company, Instructions for Care and Operation for ClarkAmatic Battery Powered Floor Maintainer Model PS 18SP, Manual, 13 pgs., Form No. 197, Clarke Floor Machine Company, Division of Studebaker Corporation, Muskegon, MI, U.S.A.

Clarke, Clarke Encore 17 Compact Scrubbers, Brochure, 4 pgs. 2003, Clarke, 2100 Highway 265, Springdale, AR, U.S.A.

Clarke, Clarke Division of ALTO Operator's Manual Encore S17/L17/Rotary/Cylindrical and Encore Section II Parts and Service Manual, Manual, 58 pgs., 2004, Form No. 70483A, Clarke, Division of ALTO, 2100 Highway 265, Springdale, AR, U.S.A.

Clarke, Clarke Division of ALTO Operator's Manual Encore S20/L20, Manual, 70 pgs., 2004, Form No. 70659A, Clarke, Division of ALTO, 2100 Highway 265, Springdale, AR, U.S.A.

Clarke, Clarke Division of ALTO Operator's Manual Encore S2426/L2426, Manual, 58 pgs., 2004, Form No. 70421A, Clarke, Division of ALTO, 2100 Highway 265, Springdale, AR, U.S.A.

Clarke, Clarke Division of ALTO Operator's Manual Encore S28XP S33XP S38XP, Manual, 60 pgs., 2004, Form No. 70657A, Clarke, Division of ALTO, 2100 Highway 265, Springdale, AR, U.S.A.

Clarke, Clarke Division of ALTO Operator's Manual Encore S28/L28 S33/L33 S38/L381, Manual, 64 pgs., 2004, Form No. 70656A, Clarke, Division of ALTO, 2100 Highway 265, Springdale, AR, U.S.A.

Clarke, Clarke Division of ALTO Operator's Manual Encore S30/L30, Manual, 58 pgs., 2004, Form No. 70762A, Clarke, Division of ALTO, 2100 Highway 265, Springdale, AR, U.S.A.

Clarke, Allway Shuttlematic SQ-200 & SQ240 Debut Presentation, 15 pgs.

* cited by examiner

ORBITAL SCRUBBER WITH STABILIZER ELEMENT

CROSS REFERENCE TO RELATED APPLICATION

This is a continuation-in-part application to patent application Ser. No. 10/905,575 filed on Jan. 11, 2005, now abandoned. The present application and application Ser. No. 10/905,575 have a common assignee, ALTO U.S. Inc. and one common inventor.

BACKGROUND OF INVENTION

Rotary type scrubbers have been used for decades to clean hard floor surfaces such as tile, linoleum, and concrete. These hard floor surfaces are often uneven which presents challenges to the scrubber and may result in a floor that is not cleaned in a uniform fashion. One approach to uneven floors is a gimbaled disc shaped scrub brush. The gimbaled design allows some degree of freedom to the brush allowing it to tilt in response to the uneven floor.

Another challenge to conventional floor cleaning is excess water consumption. In the past, it was a widely held belief that the more water that was applied to the floor, the cleaner it could be scrubbed. Within the last few years, this notion has fallen from favor as the floor cleaning industry has become more ecologically conscious. Various approaches have been developed by several floor equipment companies using rotary type scrubbers discussed below.

One approach to the challenge of excess water consumption was developed by the Tennant Company of Minneapolis, Minn. (www.tennantco.com) and is disclosed in U.S. Pat. Nos. 6,585,827; 6,705,332 and 6,705,662. Tennant calls this the FaST™ foam scrubbing technology. Tennant promotional material represents that this technology increases scrubbing productivity up to 30% for rotary type scrubbers. However, this rotary type scrubber still has splash skirts.

Yet another approach to the challenge of excess water consumption was developed by Windsor Industries of Denver, Colo. (www.windsorind.com) and is referred to as the Aqua-Mizer™ which is disclosed in U.S. Pat. No. 7,025,835 entitled "Scrubbing Machine Passive Recycling", issued on Apr. 11, 2006. Windsor promotional material represents that this technology increases run-time productivity by 35 to 50% per tank fill up. This system apparently is standard on all of the Windsor Saber Cutter models which are rotary type scrubbers. However, this rotary type scrubber still has splash skirts.

A different approach to the challenge of excess water consumption has been developed by Penguin Wax Co. Ltd., of Osaka, Japan (www.penguinwas.co.jp). Penguin offers a scrubber called the "Shuttlematic" model numbers SQ 200 and the SQ 240. Instead of the rotary motion of the aforementioned floor scrubbers, the Shuttlematic uses two flat pads positioned perpendicular to the direction of travel of the machine. Penguin promotional material represents that the Shuttlematic has longer run time, less power consumption and no water splash. The Shuttlematic does not have splash skirts. Another prior art shuttle type design without splash skirts is disclosed in U.S. Pat. No. 1,472,208. The shuttle motion of the '208 patent is different from the shuttle motion of the Shuttlematic. Notwithstanding the aforementioned prior art scrubbers, there is still a need for a floor cleaning machine that will conserve water and power and still do a good job scrubbing uneven hard floor surfaces.

Applicant has developed a different approach that conserves water and power and still does an excellent job scrubbing uneven hard floor surfaces. The present invention is an orbital scrubber. It is a marriage between some of the features found in prior art rotary motion scrubbers for hard floor surfaces and some of the features found in prior art orbital motion sanders for finishing wood floors. Applicant's assignee of the present invention, Clarke, a division of ALTO U.S. Inc. has previously sold an orbital motion sander for finishing wood floors, model number OBS 18, among others, as pictured on the advertisement and operator's manual included in the information disclosure statement. This orbital motion has been combined with some of the features of the prior art rotary motion Encore scrubbers also sold by Clarke, a division of ALTO U.S. Inc. Operator's manuals for various Encore rotary motion scrubbers are likewise included in the information disclosure statement.

In the mid-1960's, Clarke introduced an orbital motion scrubber for hard floor surfaces, model number BP-18-SP, which was on sale for several years during which more than a thousand units were sold. The BP-18 did a poor job cleaning uneven floors. Apparently, customers would make an initial purchase, but follow-up sales were difficult to close because of the uneven cleaning problem. Sales eventually dried up. The BP-18 had a high solution flow rate of approximately 1.1 gallons per minute at the full flow setting and therefore required splash skirts around the cleaning head assembly. In contrast, the present invention uses comparatively low cleaning solution flow rates and therefore no splash skirts are needed. The BP-18 was a failed attempt from the mid-1960's at an orbital motion scrubber.

The BP-18 failed for a number of reasons, but certainly one of the reasons was because the pad driver was a rigid piece of metal that did not flex in response to uneven features in the floor. As a result, the cleaning was uneven. The cleaning pad on the BP-18 was thin and thus easily damaged. (This prior art cleaning pad was about 0.19 inches thick). Furthermore, tools were required to make a pad change. Further, the BP-18 had a fixed weight of 35 pounds that applied this non-adjustable load on the cleaning head assembly. Notwithstanding this prior art orbital motion scrubber for hard floor surfaces, and prior art orbital motion sanders for finishing wood floors and prior art rotary motion scrubbers, there is still a need for a floor cleaning machine that will conserve water and power and still do a good job scrubbing uneven hard floor surfaces.

In some orbital scrubbers, the vibration dampening elements may fail due to vertical and horizontal stress caused by a number of factors including repeated lifting of the cleaning head assembly off the floor and inadvertent collisions with door jams, walls and other non-movable objects. The present invention includes at least one and preferably two stabilizer elements that reduce vertical and horizontal stress to upper vibration dampening elements.

SUMMARY OF THE INVENTION

The present invention uses high speed orbital motion to move a flexible pad driver attached to a removable cleaning element. The term "cleaning element" as used herein includes both cleaning pads and brushes with bristles. Unlike some prior art attempts, no tools are required to change the cleaning element on the present invention. Cleaning solution is evenly applied to the floor immediately in front of the cleaning element or to the leading edge of the cleaning element in quantities that are comparatively less than usage of many conventional rotary motion scrubbers of comparable scrub width. Less cleaning solution consumption equates to a longer run time between tank refills. Because less cleaning solution is used, the present invention does not need or have splash skirts. The absence of splash skirts allows the orbital scrubber to get into tight places and into a square corner. The orbital scrubber also uses less electrical energy than conventional rotary motion scrubbers of comparable scrub width. A flexible pad driver results in better cleaning of uneven floor surfaces than some prior art designs with rigid pad drivers.

The present invention also includes at least one stabilizer element that reduces vertical and horizontal stress to upper vibration dampening elements.

BRIEF DESCRIPTION OF DRAWINGS

FIG. 21 FIG. 20 is a partial perspective view of a fourth alternative embodiment of the stabilizer pin.

DETAILED DESCRIPTION

Figure 1:
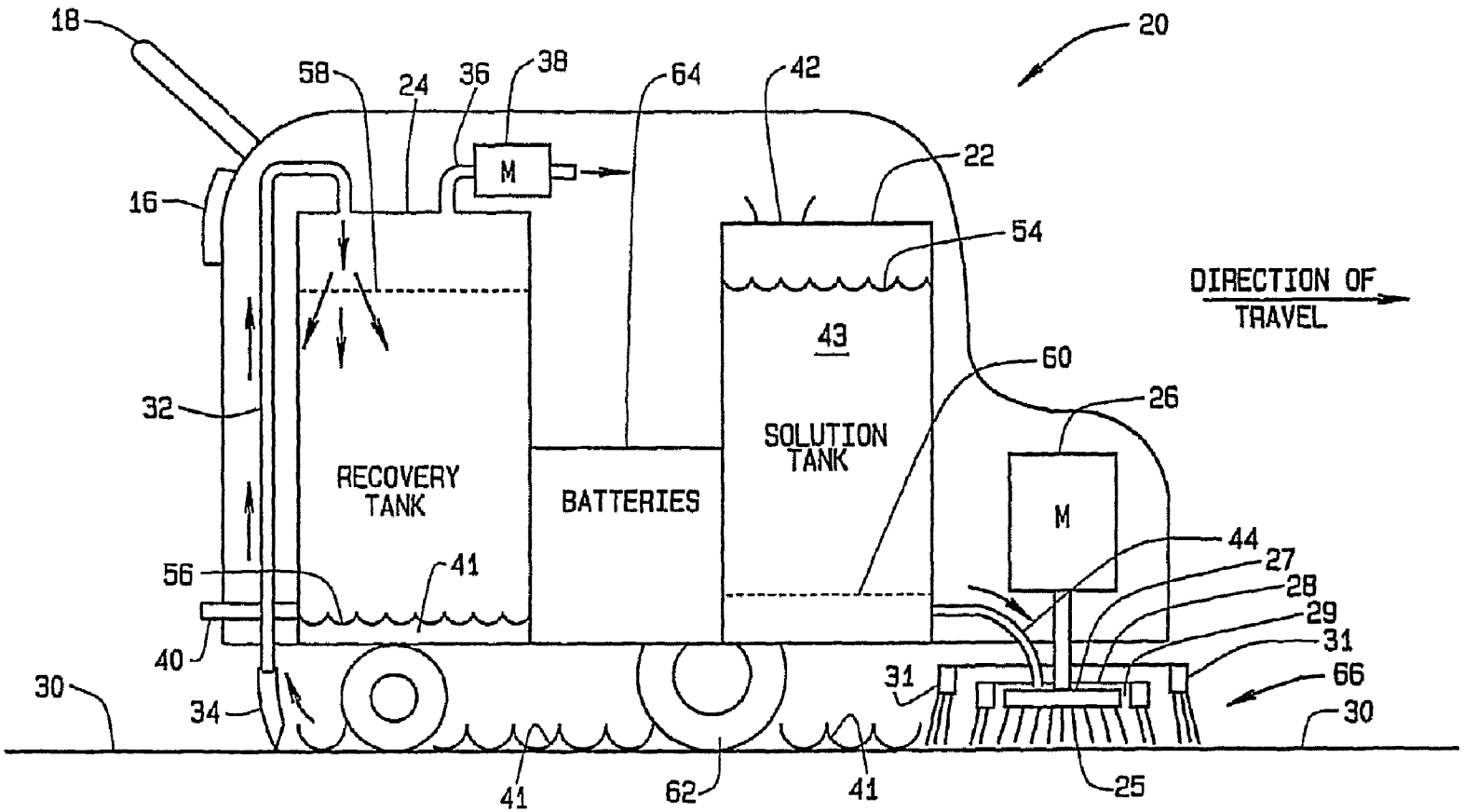
FIG. 1 PRIOR ART
FIG. 1 is a schematic of a prior art rotary motion scrubber.

FIG. 1 is a schematic diagram of a prior art rotary motion type scrubber generally identified by the numeral 20. These scrubbers can use disc shaped brushes or cleaning pads that operate in a rotary motion about the shaft of the brush motor. These scrubbers are therefore referred to herein as rotary motion type scrubbers. Scrubbers of this type are designed to clean hard floor surfaces such as tile, linoleum, and concrete. These rotary motion scrubbers are typically used in medical facilities, office buildings, educational facilities, restaurants, convenience stores, and grocery stores.

The operator, not shown, walks behind the scrubber 20 and grips the handle 18 to control the direction of travel as indicated by the arrow at the front of the scrubber. A control panel 16 is positioned at the rear of the scrubber and has various control devices and systems well known to those skilled in the art. The control devices and systems are in electrical connection with the various operating components of the scrubber. There is no standardized set of control devices and systems on each and every rotary scrubber, but the following are available on some rotary scrubbers.

There is typically an on/off switch, not shown, and a cleaning head assembly position control device. The cleaning head assembly typically has an upper position where the brush bristles are not in contact with the floor surface and a lower position where the brush bristles are in contact with the floor surface. When the on/off switch is "on" and the cleaning head assembly is put in the lower position, a touch down switch, not shown, activates the brush motor to scrub the floor.

There may be a control device to vary the amount of downward load on the cleaning head assembly. Some scrubbers have an adjustable actuator that varies the amount of downward load on the cleaning head assembly. Some scrubbers have weights on the cleaning head assembly that exert a constant load. For those scrubbers with adjustable load control devices, a heavy load is used for very dirty floors. Lightly soiled floors require minimum load. The heavier the load on the cleaning head assembly, the higher the amp. draw of the brush motor and the less the battery run time. The amp. draw of a ¾ HP brush motor for the present invention is greater than about 8 amps. and less than about 18 amps. depending on the amount of the downward load on the cleaning head assembly.

There may be an adjustable speed control device, not shown, to control the speed of the traction motor which dictates the forward speed of the scrubber. Some scrubbers do not have traction motors and rely on the rotation of the brushes to help move the machine forward. However, on those scrubbers that have traction motors, the faster the speed the higher the amp. draw which reduces battery run time and vice-a-versa.

There may also be an adjustable flow control device, not shown, for the cleaning solution. There is typically a squeegee position control device, not shown. The squeegee 34 typically has a full up, full down and medium height position, which is typically a manual lever. The squeegee 34 also has a touch down switch, not shown, to turn on the vacuum motor 38 when the squeegee 34 is in the full down position to suck up dirty fluid 41. The medium setting on the squeegee 34 is to clear the squeegee conduit 32 when scrubbing is complete so it does not drip dirty fluid on a clean floor or elsewhere. The full up position is used to move the scrubber 20 from place to place when scrubbing is not desired, as over clean floors, or back to the janitor's closet to drain the recovery tank 24 and refill the solution tank 22.

The rotary motion scrubber 20 has a solution tank 22 and a recovery tank 24. A brush motor 26 drives a disc shaped brush 28 which has bristles 25 which engage the hard surface floor 30. A conduit 32 connects the squeegee 34 to the recovery tank 24. A conduit 36 connects the recovery tank 23 with the vacuum motor 38 which is vented to atmosphere. A drain 40 is used to drain the dirty fluid 41 from the recovery tank 24.

Concentrated cleaning solution 43 is poured into the solution tank 22 through the solution tank inlet 42. The cleaning solution 43 is a liquid and typically includes a mixture of tap water and a cleaning agent such as concentrated floor soap. Typically, the concentrated cleaning agent is poured into the solution tank 22 and then tap water is added in the desired amount. In most situations, the solution tank 22 is filled to the top with water and concentrated floor soap. When the scrubber is scrubbing, the cleaning solution 43 passes from the solution tank 22 through the solution conduit 44 to the brush 28. The cleaning solution is then scrubbed against the floor 30 by the rotating bristles 25 of the brush 28. As the scrubber 20 moves forward as indicated by the arrow 52, a squeegee 34 sucks up the dirty fluid 41 from the floor 30 and the dirty fluid moves through the conduit 32 into the recovery tank 24.

As shown in FIG. 1 the scrubber 20 has just begun a shift and there is more cleaning solution 43 in the solution tank 22, as indicated by the fluid level line 54 than dirty fluid 41 in the recovery tank as indicated by the fluid level line 56. However, when the recovery tank 24 is full as indicated by the dashed fluid level line 58, the solution tank 22 will be empty or nearly empty as indicted by the dashed fluid level line 60. When the recovery tank is full as indicated by the fluid level line 58, a float shut off switch turns off the brush motor 26 and the vacuum motor 38. The operator therefore knows it is time take the scrubber to a janitor's closet or other suitable location to drain the recovery tank through the drain 40. The process is then repeated. The solution tank 22 is refilled with a mixture of water and concentrated cleaning solution 43 and the scrubber can be taken back to a work area and can recommence scrubbing the floor. The batteries 64 are typically recharged overnight after the job is completed.

Most scrubbers, like the scrubber 20 have traction wheels 62 that facilitate movement of the scrubber to and from the work area to the janitor's closet. Some scrubbers have a traction motor, not shown to power the traction wheels 62. All scrubbers like the scrubber 20 have a power supply to power the brush motor 26, the vacuum motor 38 and if so equipped, the traction motor. In some scrubbers, the power supply is two or more 12 or 6-volt DC rechargeable batteries 64, mentioned above. In other scrubbers the power supply is 110 volts AC or 220 volts AC. When AC powered, the scrubber has a long extension cord used to access wall mounted AC receptacles.

While scrubbing, cleaning solution 43 passes through the cleaning solution conduit 44 and feeds out by gravity to the top of the brush 27. The brush has a plurality of holes 29 through the top of the brush 27 that allow some of the cleaning solution 43 to pass through the brush to the bristles 25 and the floor 30. Unfortunately, the brush 28 is rotating at about 200-300 RPM so much of the cleaning solution 43 is flung off the top of the brush 27 by centrifugal force. Splash skirts 31 surround the brushes 28 to contain the cleaning solution that is being flung off the top of the brush 27. To Applicant's knowledge, all rotary motion floor scrubbers have some type of splash skirt to contain the cleaning solution that is flung off the top of the brush 27. The cleaning head assembly is generally identified in FIG. 1 by the numeral 66. The cleaning head assembly is an assembly that typically includes one or two brushes contained by a splash skirt on the front and sides of the cleaning head assembly. In the industry, the terms cleaning head assembly, rotary head, scrub head and brush head are used interchangeably.

An actuator, not shown applies downward forces on the cleaning head assembly 66 to facilitate cleaning of uneven floors. Really dirty floors require more load on the cleaning head assembly 66. However, heavier loads on the cleaning head assembly 66 require more electricity to drive the brush 28. The load or downward pressure on the cleaning head assembly can be up to about 200 lbs. depending on the machine. For example, the Clarke, Encore 17" scrubber can apply from 0 to about 90 lbs. of force on the cleaning head assembly; the Encore 24"-26" scrubbers can apply from 0 to about 150 lbs. of force on the cleaning head assembly. The Encore 28" to 38" can apply from about 120 lbs. to about 220 lbs of force to the cleaning head assembly. The cleaning head assembly 66 can be moved from the lower position shown in FIG. 1 where the bristles 25 engage the floor 30 to an upper position, not shown, so the bristles do not touch the floor. The upper position is used when the scrubber needs to be moved about from one place to the next. The lower position, shown in FIG. 1 is used when the floor cleaning machine is scrubbing the floor.

The Encore 2426 has a "battery run time" of about 3-4 hours before the rotary scrubber needs to be recharged. The Encore 2426 has a "solution run time" between tank refilling/emptying of about one hour. In other words, it takes about one hour of floor scrubbing to use all of the cleaning solution in the 20 gal. solution tank, at the half flow setting. Then it is time to take the rotary motion scrubber to the deep sink in the janitors' closet or other suitable location for draining. The recovery tank is then refilled with cleaning solution and the scrubber is taken back to the work area for more scrubbing. It may take the operator 30-40 minutes to complete a refill cycle including the trip back and forth to and from the deep sink. So if the number of refills per hour can be reduced it means time saved and is an advantage for any floor cleaning machine.

One reason the Encore 2426 uses so much cleaning solution is the disc type brush that rotates at approximately 200 RPM. As previously discussed, the centrifugal force created by rotation to the disc type brush drives the cleaning solution away from the brush and bristles. This solution never gets used for scrubbing purposes and is controlled by the splash skirt and picked up by the squeegee. These brushes may be adjusted from a width of about 24 inches to a width of about 26 inches and thus the model number 2426.

The present invention in the 2426 version can use a ¾ HP direct drive brush motor which causes the cleaning element to orbit at about 2,250 RPM. The ¾ HP brush motor will draw about 10-14 amps while scrubbing. But because the motion is orbital rather than rotational, the cleaning solution is not driven away from the cleaning pad so less cleaning solution is needed for the same amount of floor space and no splash skirts are required. In addition, because the motor draws less current it may also extend the run time of the batteries.

The present invention in a 2426 version has a battery run time of about of about 5-6 hours before the orbital scrubber needs to be recharged. The present invention in a 2426 version with a 20 gal. solution tank has a solution run time at the half flow setting of about 100 minutes; whereas, the Encore 2426 with a 20 gal. solution tank has a solution run time at half flow setting of about 57 minutes. For comparison purposes, the present invention, with a 20 gal. solution tank uses about 0.6 refills per hour (60 min.÷100 min), at the half flow setting; whereas an Encore 24" with the same size tank uses about 1 refill per hour at the half flow solution setting (60 min÷57 min). It is a distinct advantage to run the machine longer between refills to eliminate the wasted time walking back and forth to the janitor's closet and the time it takes to drain and refill the machine. Thus the present invention has a clear advantage because it uses less water and therefore requires fewer tank refills compared with most prior art rotary scrubbers.

Figure 2:
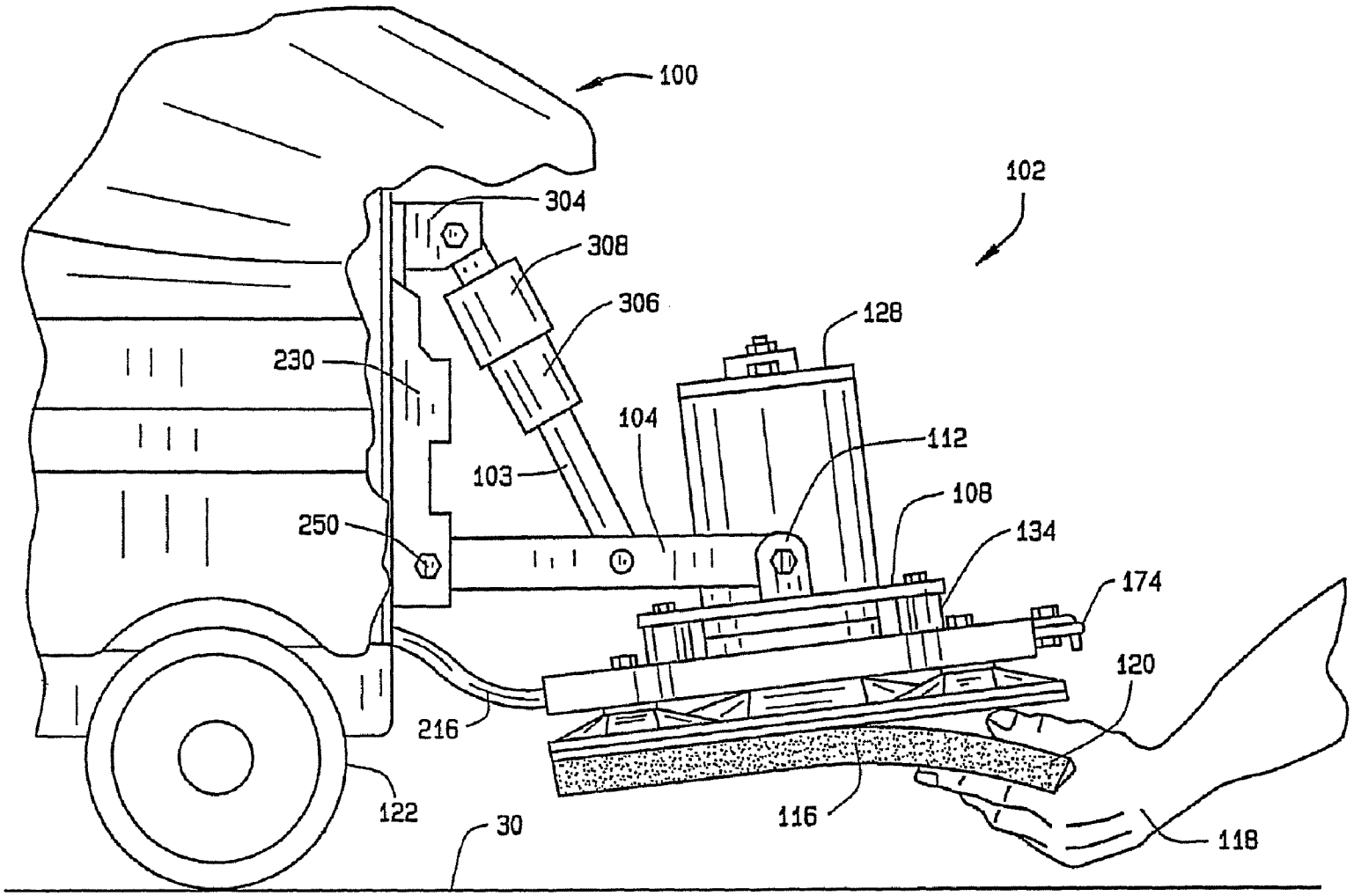
FIG. 2 is a side view of the present invention, the orbital scrubber.

FIG. 2 is a side view of the present invention, the orbital scrubber which is generally identified by the numeral 100. The cleaning head assembly is generally identified by the numeral 102. The orbital scrubber shown in this and subsequent drawings uses a cleaning element 116. The term cleaning element 116 as used in this application includes both removable cleaning pads 117 and removable cleaning brushes 296, of FIG. 10. Various flexible cleaning pads 117 have been found suitable as a cleaning element 116, including various pads sold by 3M of Minneapolis, Minn., such as the high productivity pad 7300, the black stripper pad 720, the eraser pad 3600, the red buffer pad 5100, the white super polish pad 4100 and the maroon between coats pad. Various removable cleaning brushes 296 may also be suitable as a cleaning element 116.

Figure 8:
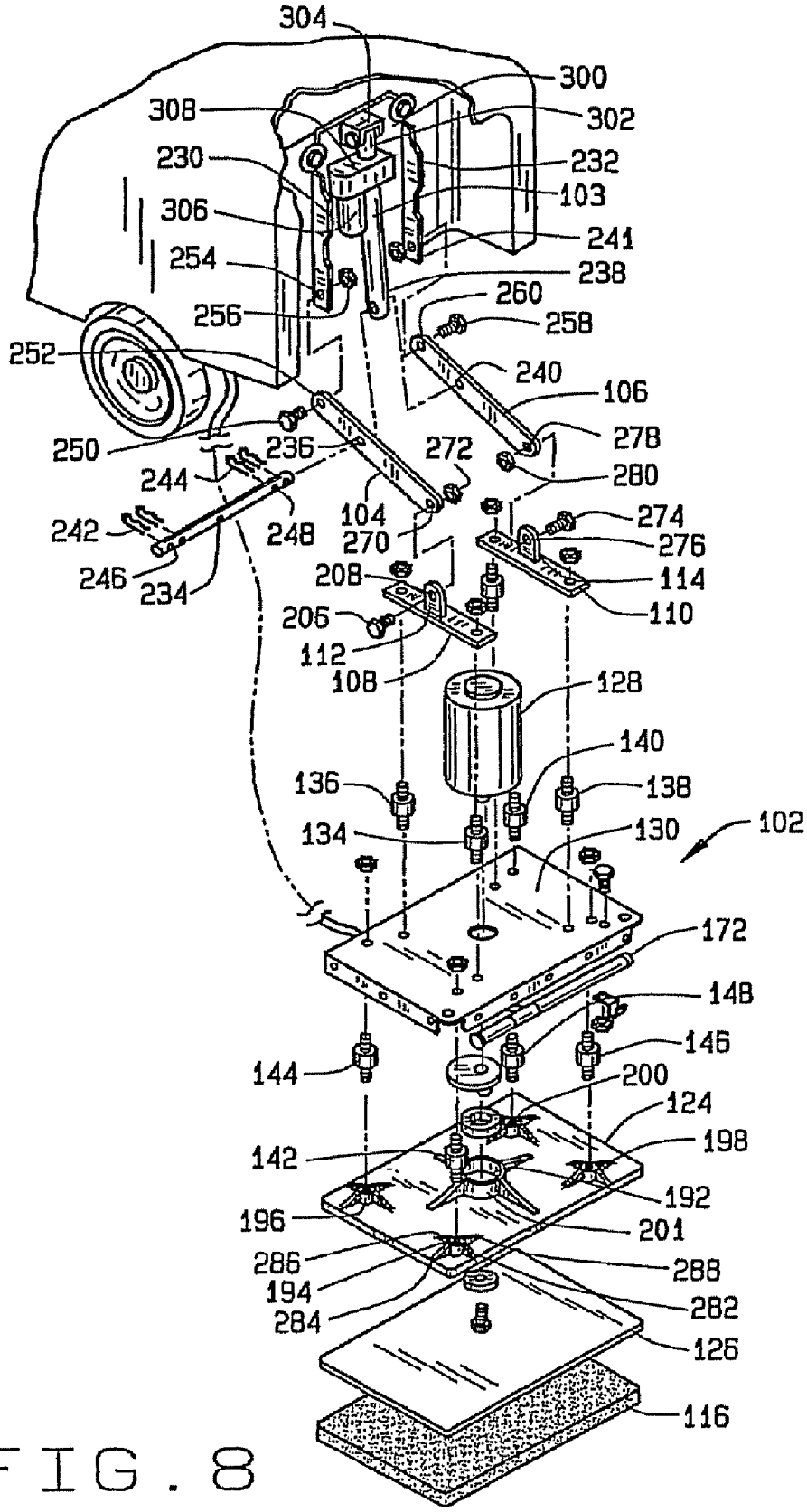
FIG. 8 is an exploded perspective view of the cleaning head assembly and the front of the orbital scrubber.

The orbital scrubber has a pair of adjustment arms 104 and 106, better seen in FIG. 8, that pivotally engage a left mounting bracket 108 and a right mounting bracket 110, better seen in the next figure. The left mounting bracket includes a left yoke 112 that adjustably connects to the left adjustment arm 104. The right mounting bracket includes a right yoke 114 that adjustably connects to the right adjustment arm, not shown in this figure. The cleaning head assembly 102 has an upper position as shown in FIG. 2 so the pad can be changed or the orbital scrubber can be easily moved from one location to the other. The cleaning head assembly 102 has a lower position shown in FIG. 3 for scrubbing the floor surface 30. In the lower position of FIG. 3, the cleaning element 116 engages the floor surface 30. A solution conduit 216 runs from the solution tank, not shown to the cleaning solution distribution tube 172, better seen 4, 5 and 8. Cleaning solution runs by gravity from the solution tank through the solution conduit 216 to the distribution tube 172 where it drips on the floor and/or the forward edge 120 of the cleaning element 116.

Figure 3:
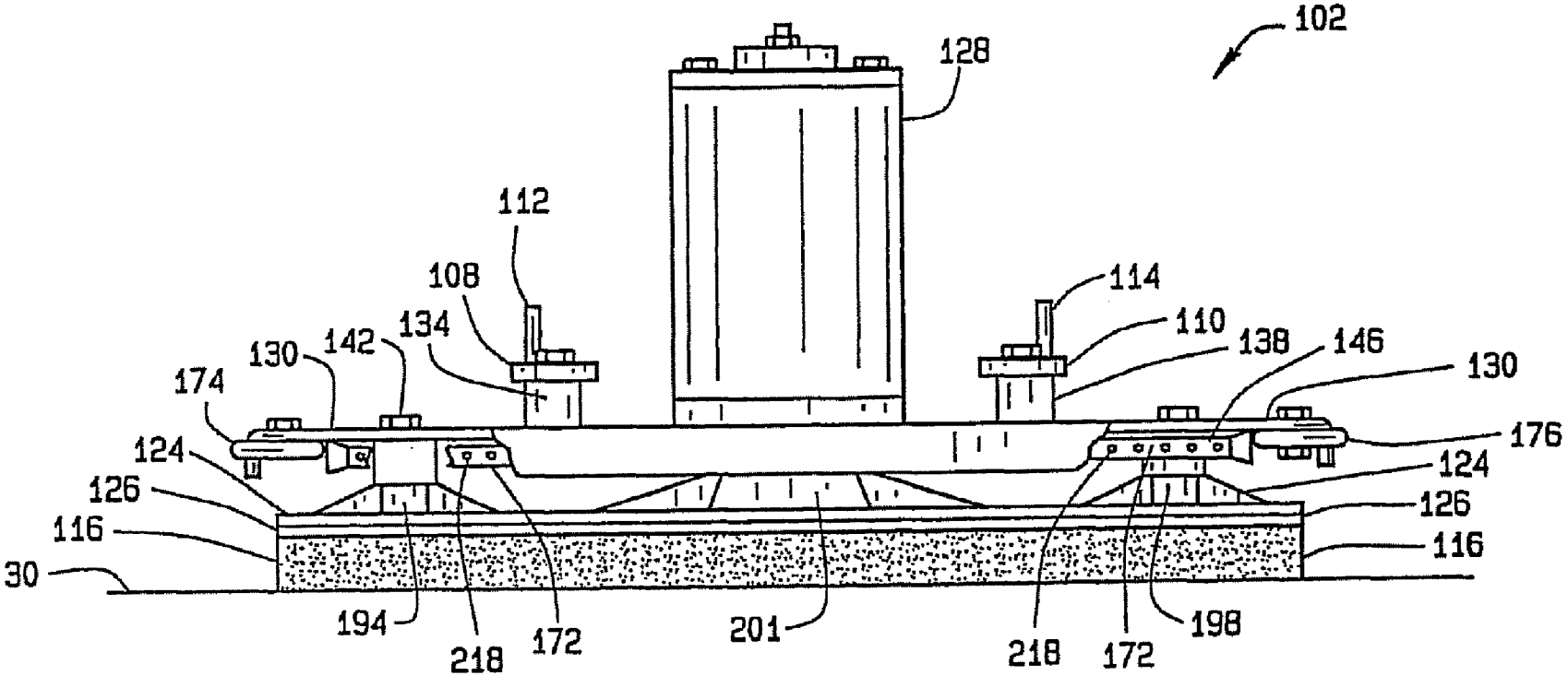
FIG. 3 is a front view of the cleaning head assembly of the orbital scrubber of FIG. 2.

The adjustment arms, including the left arm 104 and the right arm, 106, not shown, raise the cleaning head assembly 102 to the upper position shown in FIG. 2 and they also lower the cleaning head assembly to the lower position shown in FIG. 3 in response to operation of the actuator. Adjustment control mechanisms are included in the orbital scrubber 100, but are not shown in detail because they are well know to those skilled in the art. The adjustment controls to raise and lower the cleaning head assembly are often mounted on the control panel, not shown, on the rear of the orbital scrubber.

In FIG. 2, the operator's hand 118 is gripping the forward edge 120 of the cleaning element 116 to remove it from the cleaning head assembly 102. From time to time, cleaning elements wear out or may be damaged and thus need to be replaced. A new cleaning element is installed in an opposite manner to the removal process. No tools are required to remove or install a new cleaning element on the present invention making it easy to replace a cleaning element. After the cleaning element has been replaced, the operator actuates the drive wheels 122 and directs the machine to the work area. The operator then lowers the cleaning head assembly 102 so the cleaning element 116 is in contact with the floor surface 30, as shown in the next figure. The raising and lowering of the cleaning head assembly 102 is accomplished by the actuator 103. A control panel, not shown is positioned on the rear of the machine near the operator. Various control devices, not shown are located on the control panel including control devices to raise and lower the cleaning head assembly as is well known to those skilled in the art.

FIG. 3 is a front view of the cleaning head assembly 102 of the orbital scrubber of FIG. 2 removed from the rest of the machine to better show the components of the cleaning head assembly 102. As previously mentioned, the left mounting bracket 108 includes a left yoke 112 which connects to the left adjustment arm 104, better seen in FIG. 2. The right mounting bracket 110 includes a right yoke 114 which connects to the right adjustment arm, not shown. Together, the adjustment arms raise and lower the cleaning head assembly 102 from the lower scrubbing position of FIG. 3 to the upper position of FIG. 2. In FIG. 3, the cleaning element 116 is in contact with the floor surface 30 so the scrubbing process can begin.

In FIG. 3, the cleaning element 116 is removably connected to the pad driver 124 by an attaching means 126. A hook and loop attaching means has been found suitable for this purpose, but any other attaching means that will removably and securely hold the cleaning element to the pad driver 124 will suffice. The hook and loop is particularly suitable because it does not require any tools to replace the pad. In this figure, the attaching means 126 is shown as a separate part from the pad driver 124. However, this is merely a matter of manufacturing convenience. The attaching means 126 may be formed as a single unit with the pad driver 124.

The brush motor 128 is mounted on the motor mounting plate 130. FIG. 3 shows a pad and not brushes. However, the term "brush motor" is commonly used in the industry to identify the motor on the cleaning head assembly regardless of whether brushes or a pad is being used. The term brush motor also distinguishes the motor on the cleaning head assembly 102 from the traction motor, not shown, that powers the drive wheels 122, better seen in the preceding figure.

Prior art rotary motion scrubbers typically use brushes that rotate about the centerline of the driveshaft of the brush motor. The present invention uses a cleaning element 116 that orbits about the centerline of the driveshaft of the brush motor and hence it is called an "orbital scrubber". The orbital movement is imparted to the cleaning element 116 by an eccentric cam 132, better seen in the next figure. The cleaning element may orbit at speeds exceeding 2000 revolutions per minute which induces vibrations in the cleaning head assembly 102. These vibrations need to be dampened to enhance the life of the orbital scrubber 100. A plurality of vibration dampening elements are positioned between the motor mounting plate 130 and the left and right mounting brackets, 108 and 110. A plurality of vibration dampening elements is also positioned between the motor mounting plate 130 and the pad driver 124. The number, location and type of vibration dampening elements will vary according to the size of the cleaning element, the size of the brush motor 128, the weight of the eccentric cam 132 and other factors. In the present invention, using a 14 by 18 inch pad with a ¾ HP motor, and a 1.5 lb. eccentric cam, applicants have found that the model 135-162 rubber spring from Accurate Products, Inc. of Chicago, Ill. is a suitable vibration dampening element; any other vibration dampening element that has long service life will also be suitable. A first upper vibration dampening element 134 and a second upper vibration dampening element 136, better seen in the preceding figure, are located between the motor mounting plate 130 and the left mounting bracket 108. A third upper vibration dampening element 138 and a fourth upper vibration dampening element 140, not shown, are located between the motor mounting plate 130 and the right mounting bracket 110.

A first lower vibration dampening element 142 and a second lower vibration dampening element 144, better seen in the following figures are located between the motor mounting plate 130 and the pad driver 124. A third lower vibration dampening element 146 and an fourth lower vibration dampening element, not shown, are located between the motor mounting plate 130 and the pad driver 124. Other vibration dampening elements and configurations are within the scope of this invention. The cleaning solution distribution tube 172 is partially shown in the cutaway portions of the motor mounting plate 130. The cleaning solution distribution tube has a plurality of holes 218 therein to allow the cleaning solution 43 to flow out of the tube onto the floor. The holes 218 are shown for illustrative purposes at the 3 o'clock position, but in the actual embodiment, they are actually positioned closer to the 5 o'clock position. The number and size of the holes varies with the width of the cleaning element 116. Suggested flow rates are discussed below.

Figure 4:
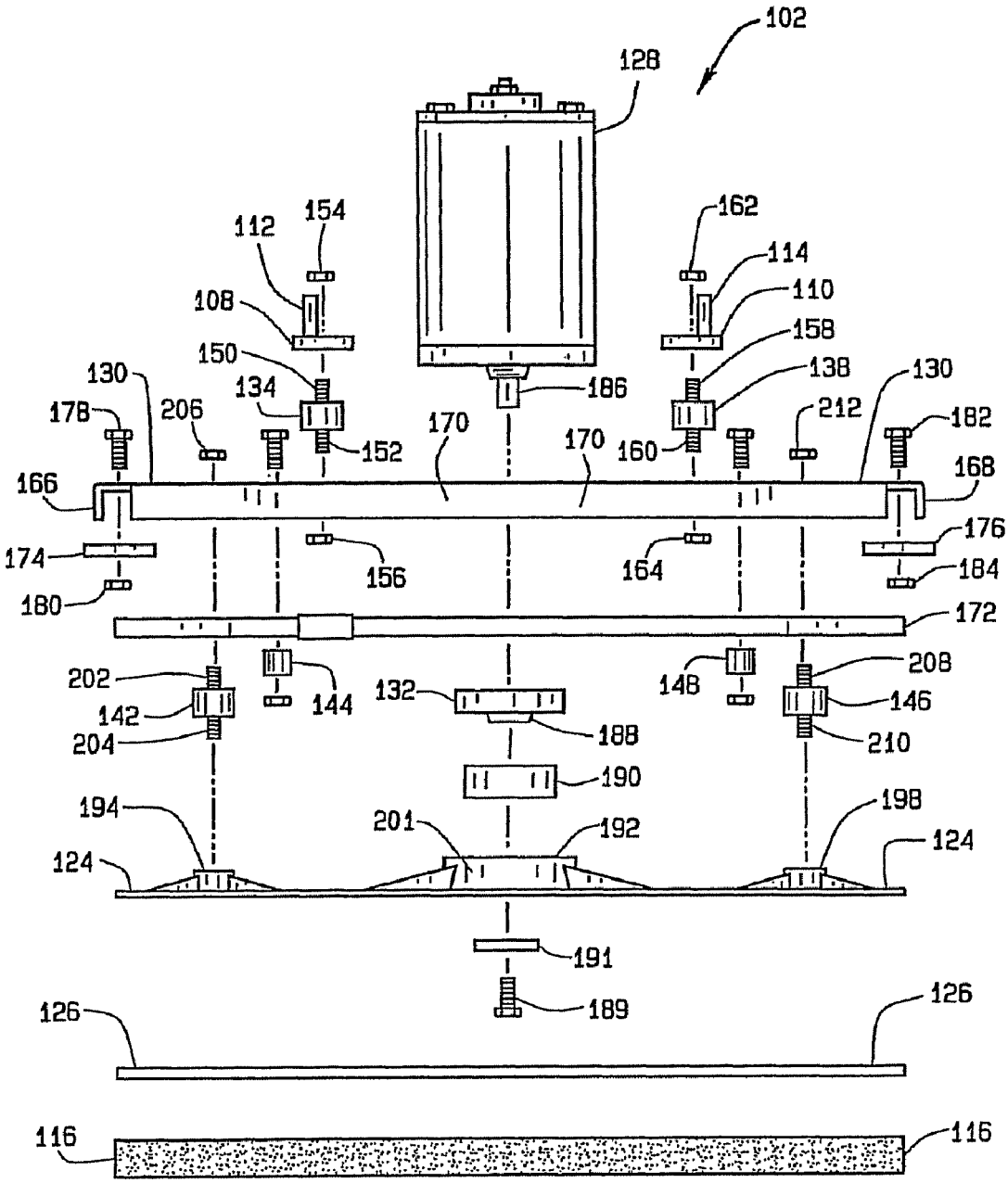
FIG. 4 is an exploded front view of the cleaning head assembly of FIG. 3.

FIG. 4 is an exploded front view of the cleaning head assembly 102 of FIG. 3. The brush motor 128 is mounted to the motor mounting plate 130. The first upper vibration dampening element 134 has a threaded shaft 150 extending from the top and another threaded shaft 152 extending from the bottom of the element. The shaft 150 passes through a hole, not shown in the left mounting bracket 108 and is secured by a nut 154. The shaft 152 passes through a hole, not shown in the motor mounting plate 130 and is secured by a nut 156. The third upper vibration dampening element 138 has a threaded shaft 158 extending from the top and another threaded shaft 160 extending from the bottom of the element 138. A nut 162 engages the threaded shaft, 158 attaching the top of the vibration dampening element 138 to the right mounting bracket 110. A nut 164 engages the threaded shaft, 160 attaching the bottom of the vibration dampening element 138 to the motor mounting plate 130.

The motor mounting plate 130 has a left lip 166, a right lip 168 and a front lip 170 formed at the outer extremities. These lips add rigidity to the motor mounting plate and protect the components housed there under, such as the pad driver 124 and the cleaning solution distribution tube 172. These lips, 166, 168 and 170 do not function as splash skirts like some of the prior art. The present invention does not have any splash skirts, because they are not needed as will be described in greater detail below.

In order to protect the cleaning head assembly 102 and to avoid damage to walls and furniture, the head 102 is equipped with two bumper wheels, 174 and 176. A bolt 178 passes through a hole, not shown in the motor mounting plate 130 and a hole, not shown in the center of the left bumper wheel 174. A nut 180 threads on the extended portion of the bolt 178 to secure the left bumper wheel 174 to the motor mounting plate 130. The left bumper wheel 174 is free to rotate about the bolt 178. A bolt 182 passes through a hole, not shown in the motor mounting plate 130 and a hole, not shown in the center of the right bumper wheel 176. A nut 184 threads on the extended portion of the bolt 182 to secure the right bumper wheel 176 which is free to rotate about the bolt 182. The left bumper wheel 174 and the right bumper wheel 176 extend beyond the motor mounting plate 130, as better seen in FIG. 3. The wheels 174, 176 will bump against walls, furniture and other fixtures to protect the cleaning head assembly 102 and the scrubber 100 in general. They will also help prevent scrapes on walls and other fixtures, when the cleaning head assembly 102 inadvertently contacts a wall or fixture.

The brush motor 128 causes a drive shaft 186 to rotate. The drive shaft 186 is mounted off center in the eccentric cam 132. An extension shaft 188 extends from and is integral with the eccentric cam 132. A ball bearing assembly 190 is pressed to fit in a journal 192 in the pad driver 124. The extension shaft 188 contacts the inside raceway of the ball bearing assembly 190. A bolt 189 passes through a washer 191 and threadably engages a hole, not shown in the extension shaft 188. When the brush motor 128 is "on" the drive shaft 186 rotates the eccentric cam which imparts orbital movement to the pad driver 124 because of the off center position of the drive shaft 186 in the eccentric cam 132. In other words, the drive shaft 186 and the extension shaft 188 are not in alignment which imparts the orbital movement to the pad driver 124.

The pad driver 124 forms a left front mounting pedestal 194, a left rear mounting pedestal 196, better seen in FIG. 8, a right front mounting pedestal 198, and a right rear mounting pedestal 200, better seen in FIG. 8. The first lower vibration dampening element 142 has an upper threaded shaft 202 extending from the top thereof and a lower threaded shaft 204 extending from the bottom of the vibration dampening element 142. The lower threaded shaft 204 threadably engages a threaded hole, not shown in this figure, in the left front mounting pedestal 194. The upper threaded shaft 202 passes through a hole, not shown in the motor mounting plate 130 and engages a nut 206. The third lower vibration dampening element 146 has an upper threaded shaft 208 extending from the top thereof and a lower threaded shaft 210 extending from the bottom. The lower threaded shaft 210 engages a threaded hole, not shown in this figure, in the right front mounting pedestal 198. The upper threaded shaft 208 passes through a hole, not shown in the motor mounting plate 130 and engages a nut 212.

Figure 5:
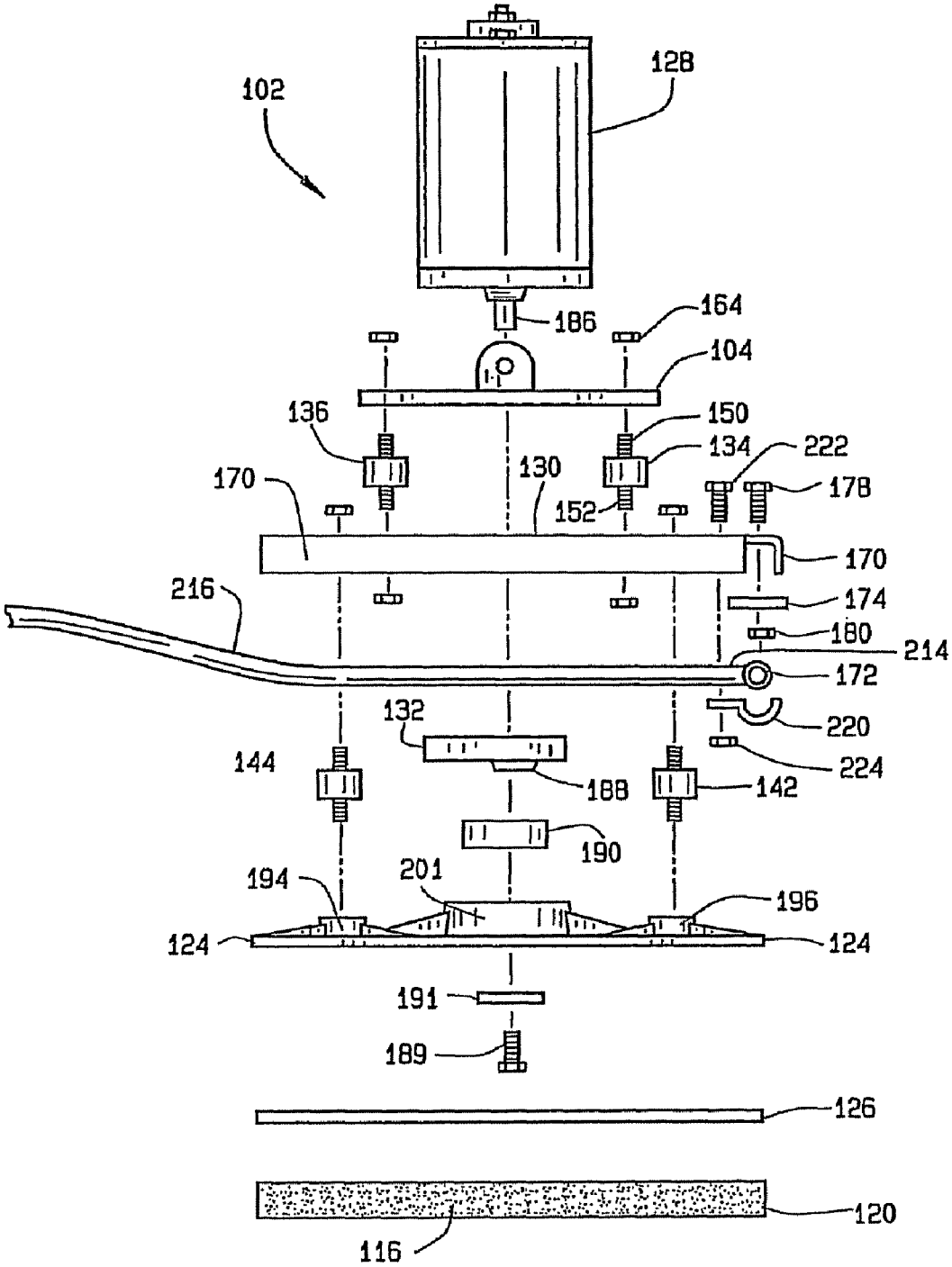
FIG. 5 is an exploded side view of the cleaning head assembly of FIG. 3.

FIG. 5 is an exploded side view of the cleaning head assembly 102 of FIG. 3. The distal end 214 of the solution conduit 216 connects to the cleaning solution distribution tube 172 which has a plurality of holes 218 therein. The proximal end, not shown of the solution conduit 216 connects to the solution tank. Cleaning solution flows by gravity from the solution tank, not shown, through the solution conduit 216 to the cleaning solution distribution tube 172 where the cleaning solution drips through the holes 218 onto the floor surface 30 and the forward edge 120 of the cleaning element 116. The cleaning solution distribution tube 172 is located proximal the forward edge 120 of the cleaning element 116 and is secured by a plurality of brackets on one of which, 220 is shown in this view. A bolt 222 passes through a hole, not shown in the motor mounting plate 130 and a hole, not shown in the bracket 220. A nut 224 threads onto the bolt 222 and secures the bracket 220 and thus the cleaning solution distribution tube 172. The cleaning solution is applied to the floor and/or the cleaning element by the cleaning solution distribution tube 172.

In an alternative embodiment, not shown, holes may be drilled in the pad driver 124 and the attaching means 126 so the cleaning solution may be applied to the top of the cleaning element 116. Because cleaning elements are porous, the force of gravity will draw the cleaning solution through the pad to the floor 30.

Figure 6:
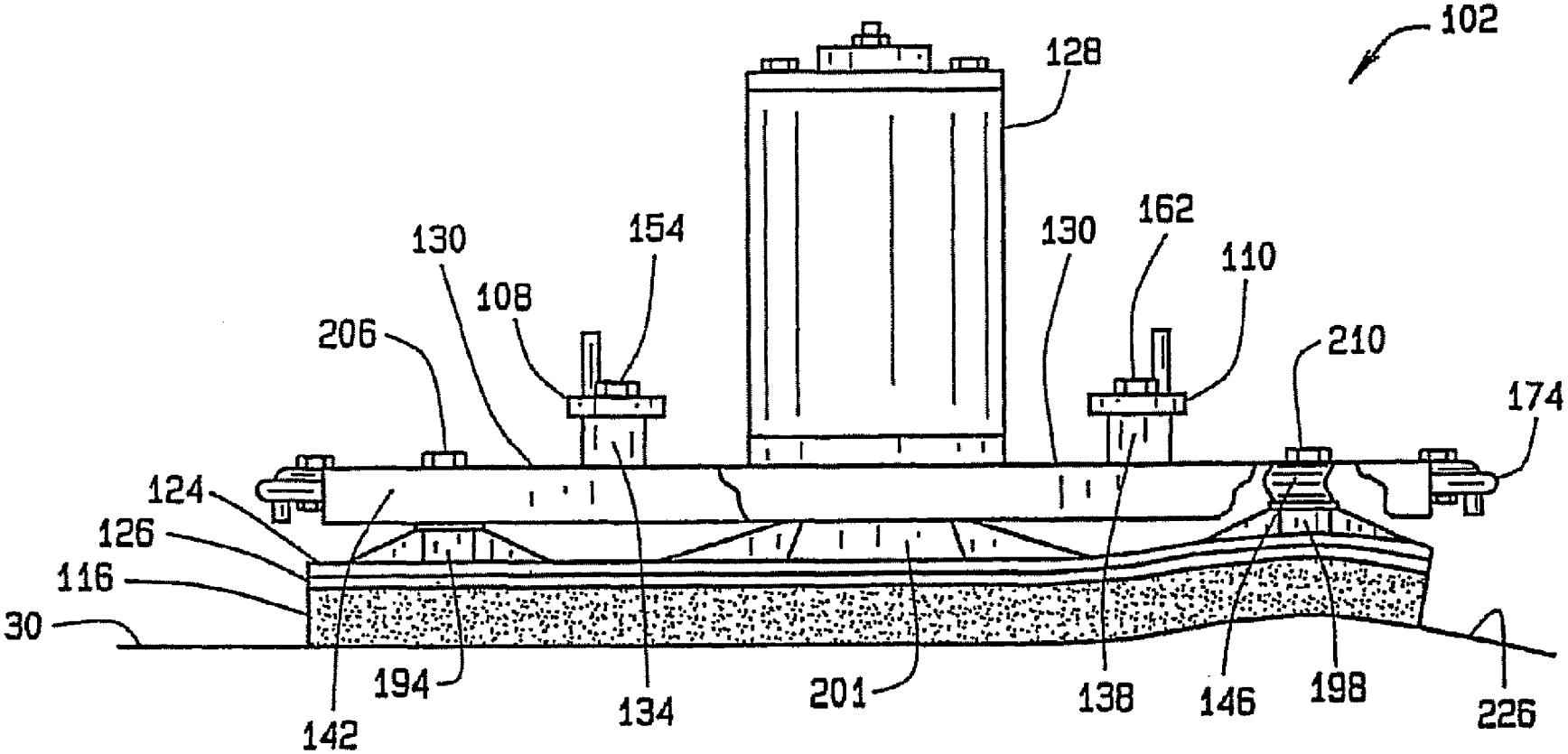
FIG. 6 is a front view of the cleaning head assembly of FIG. 3 when it encounters an uneven floor surface.

FIG. 6 is a front view of the cleaning head assembly 102 of FIG. 3 when it encounters an uneven floor surface 226. Unlike prior art pad drivers used in scrubbers, the flexible pad driver 124 of the present invention deflects to accommodate the uneven floor surface 226. Most of the components in the cleaning head assembly 102 are flexible including the cleaning element 116 and the attaching means 126 which further allows accommodation and bending to adapt to uneven floor surfaces, an example of which is shown as 226 for illustrative purposes. In addition, the upper and lower vibration dampening elements are flexible and can be distorted to further help accommodate to uneven floor surfaces. For illustrative purposes, the lower right front vibration dampening element 146 is shown in an exaggerated deflected state to help accommodate the uneven floor surface 226. Although the motor mounting plate 130 is rigid, it can tilt somewhat due to the flexibility of the upper vibration dampening elements, two of which can be seen in this view, 134 and 138.

The flexible pad driver 124 is an important feature of the present invention. The prior art orbital sanders sold by applicant's assignee require rigid pad drivers in order to smooth out any high spots on wooden floors. A rigid pad driver sands high spots continuously without getting into low spots until the wood floor is smooth and even. A flexible pad driver in the sanding application would work to exaggerate any high or low spots. The flexible drive plate 124 of the present invention allows the orbital scrubber to follow the contour of uneven hard floor surfaces without putting excessive scrubbing force on high spots in the floor. Excessive scrubbing force could cause damage to the finish on high spots on the tile floors. The pad driver must have enough flex to follow uneven floor contours yet have enough stiffness to transmit the proper amount of load and scrubbing force to clean the entire surface area. (The actuator applies downward force to the flexible pad driver and the cleaning element.) Prior art floor burnishers, also sold by applicant's assignee require a floppy pad driver as they are operated at high RPM's (typically more than 2,000 RPM) in order to polish a floor. The pad driver must be floppy enough to be sucked down to the floor due to the vacuum of the high RPM spinning of the pad driver. Only a very floppy pad driver can maintain contact with an uneven floor surface while burnishing, since there is no other force pushing or pulling down on it other than a vacuum. In conclusion, the pad driver can be too rigid and stiff, like the drivers used in prior art sanders, or it can be too flexible, like the drivers used in floor burnishers. The term "flexible pad driver" as used herein means one that is flexible enough to scrub uneven floor surfaces. The flexible pad driver may be produced from plastic, such as nylon.

Figure 7:
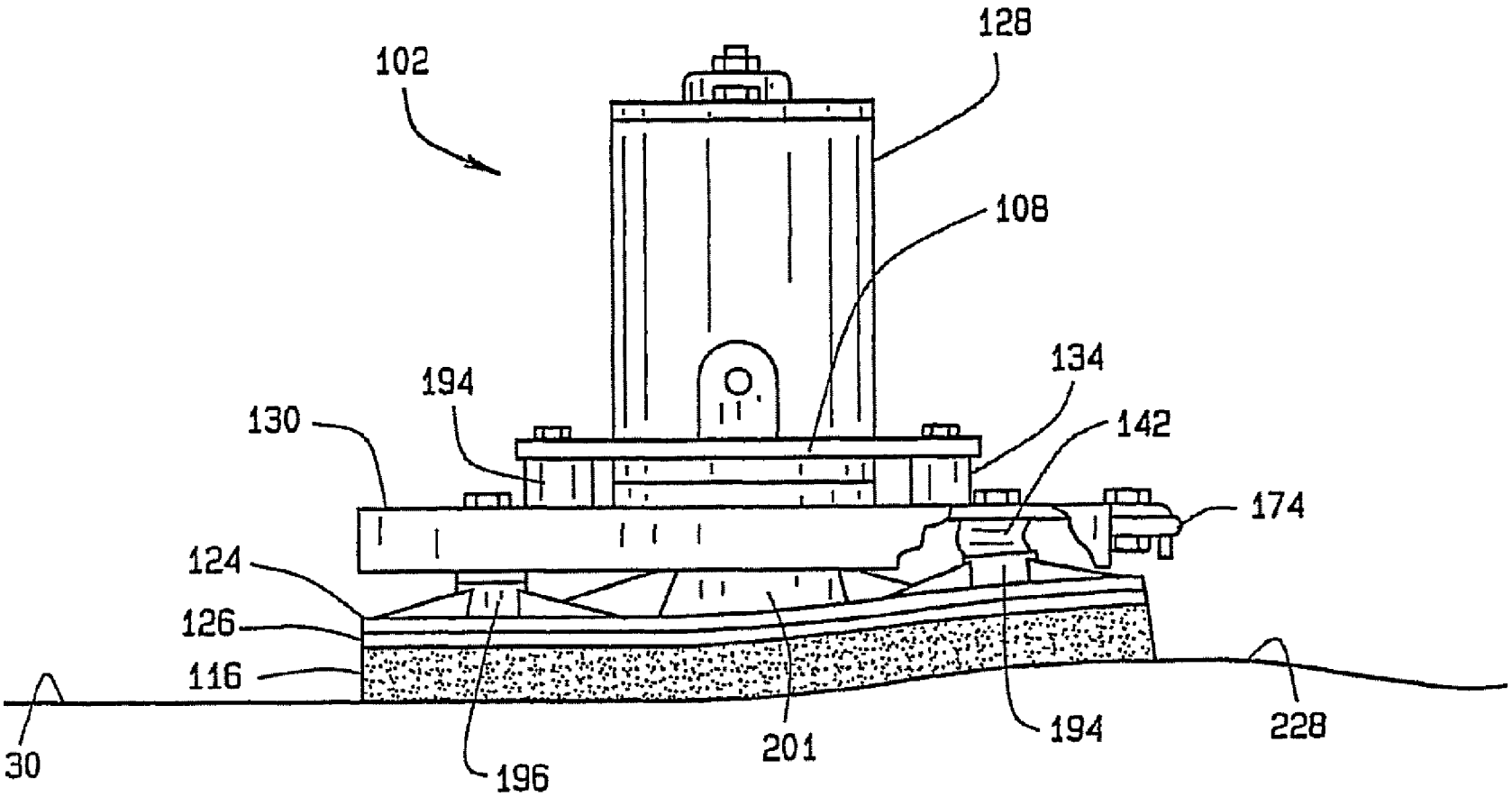
FIG. 7 is a side view of the cleaning head assembly of FIG. 3 as it flexes to scrub an uneven floor surface.

FIG. 7 is a side view of the cleaning head assembly 102 of FIG. 3 as it flexes to scrub another uneven floor surface 228. The left front lower vibration dampening element 142 is shown for illustrative purposes in an exaggerated deformed state. The cleaning element 116, the attaching means 126 and the pad driver 124 all flex to accommodate the uneven floor surface 228. Again the drawing is exaggerated for illustrative purposes. The motor mounting plate 130 may also tilt slightly to accommodate the uneven floor surface 228.

FIG. 8 is an exploded perspective view of the cleaning head assembly generally identified by the numeral 102 and the front of the orbital scrubber generally identified by the numeral 100. A support bracket 300 is mounted in the front of the orbital scrubber 100. The left flange 230 of the support bracket and the right flange 232 of the support bracket 300 are visible in this view. The proximal end 302 of the actuator 103 is pivotally mounted on a support element 304 extending from the support bracket 300.

An actuator pin 234 passes through a hole 236 in the left support arm 104, a hole 238 in the distal end of the actuator 103 and a hole 240 in the right support arm 106. Left pins 242 and right pins 244 pass respectively through holes 246 and 248 in the opposite ends of the actuator pin 234. A bolt 250 passes through a hole 252 in the proximal end of the left adjustment arm 104 and a hole 254 in the left flange 230. A nut 256 secures the threaded bolt 250. A bolt 258 passes through a hole 260 in the right adjustment arm 106. A nut 264 secures the threaded bolt 258. Thus the left adjustment arm 104 and the right adjustment arm 106 are pivotally mounted to the front end of the orbital scrubber 100 and their position is controlled by the actuator 103.

A bolt 266 passes through a hole 268 in the left yoke 112 and a hole 270 in the distal end of the left adjustment arm 104 and is secured by a nut 272. A bolt 274 passes through a hole 276 in the right yoke 114 and a hole 278 in the right adjustment arm 106 and is secured by a nut 280. In this fashion, the left adjustment arm 104 pivotally connects to the left mounting bracket 108 and the right adjustment arm 106 pivotally connects to the right mounting bracket 110 which allows the cleaning head assembly 102 to move from the upper non-scrubbing position of FIG. 2 to the lower scrubbing position of FIG. 3 when the actuator 103 is operated. As previously discussed, a control panel 16 is positioned at the rear of the machine, near the operator and a control mechanism regulates operation of the actuator 103. In addition to raising and lowering the cleaning head assembly 102, the actuator 103 applies downward load on the cleaning head assembly 102 while scrubbing. The amount of downward load can be adjusted by the control mechanism. Floor surfaces that are very dirty require more load on the cleaning head assembly 102 for effective cleaning than floor surfaces that are lightly soiled. Skilled operators will adjust the load on the cleaning head assembly 102 according to the level of dirt on the floor.

The actuator 103 is adjusted as follows by a control mechanism, not shown on the control panel 16, better seen in FIG. 1. The operation of the actuator 103 is well known to those skilled in the art; however, it is briefly explained herein for clarity. The control mechanism, not shown controls a reversible drive motor 306 operatively connected to a gear box 308. The gear box 308 connects to a threaded shaft, not shown in the actuator 103. When the motor 306 is operated in one direction it operates the gear box and the threaded shaft, not shown which lowers the cleaning element 116 of the cleaning head assembly 102 into contact with the floor as shown in FIG. 3. Further operation of the motor 306 places a downward load on the cleaning head assembly 102 and the cleaning element 116. When the motor 306 is operated in the opposite direction it operates the gear box 308 and the threaded shaft in the opposite direction, thus raising the cleaning head assembly 102 as shown in FIG. 2 so the cleaning element 116 can be replaced or the apparatus can be rolled about, for example to refill the solution tank.

As previously discussed, four upper vibration dampening elements, 134, 136, 138 and 140 are positioned between the motor mounting plate 130 and the mounting brackets, 108 and 110. Four lower vibration dampening elements, 142, 144, 146 and 148 are positioned between the motor mounting plate 130 and the pad driver 124. The eight vibration dampening elements a) help reduce vibration caused by the orbital movement of the pad driver 124 and cleaning element 116 and b) help the cleaning element adjust to uneven floor surfaces 126, 128 as illustrated in FIGS. 6 and 7.

One embodiment of the flexible pad driver 124 has four mounting pedestals 194, 196, 198 and 200 that connect to the four lower vibration dampening elements 142, 144, 146 and 148. A central mounting pedestal 201 is positioned in the center of the flexible pad driver 124. In one embodiment of the flexible pad driver 124, each of the mounting pedestals 194, 196, 198, 200 has a plurality of webs extending from the pedestal. For example, mounting pedestal 194 has a front web 282, a left web 284, a rear web, 286 and a right web 288. These webs provide structural support for the pedestal and help direct an even load on the cleaning element 116. The bumper wheels 174 and 176 have been eliminated from this figure to better depict other elements of the apparatus.

Figure 9:
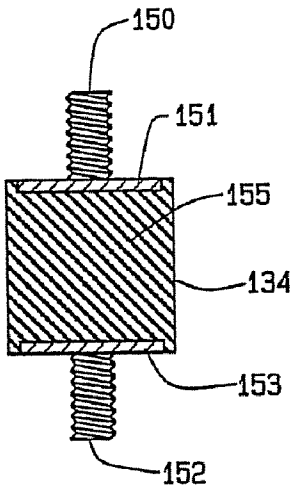
FIG. 9 is a cross-sectional view of a vibration dampening element.

FIG. 9 is a cross-section of the vibration dampening element 134. The element 134 is the same as all the other vibration dampening elements, 136, 138, 140, 142, 144, 146, and 148 shown in the previous drawings. The vibration dampening element 134 has an upper threaded shaft 150 and a lower threaded shaft 152. The shaft 150 extends from a support plate 151 and the shaft 152 extends from a support plate 153. The body 155 of the vibration dampening element 134 is formed from natural rubber and has a durometer of 40, but other ratings may also be suitable. Applicant has determined that a rubber spring, model number 135-162 manufactured by Accurate Products, Inc. of Chicago, Ill. is suitable for this application. Man-made elastomers may also be suitable as well as other rubber springs from other manufacturers. In some applications, metal springs may also be suitable and are included in the definition of "vibration dampening element" as used in this application. Other types of vibration dampening elements may also be suitable as long as they have some degree of flexibility to allow the pad driver to adjust to uneven floor surfaces.

Table 1 below compares various features of the prior art BP-18 orbital scrubber with a 6"×18" cleaning element, the prior art Encore 17 rotary scrubber with a 17" diameter rotary brush, the present invention having a 14"×18" cleaning element, the prior art Encore 2426 rotary scrubber with two 13" diameter rotary brushes and the present invention having a 14"×24" cleaning element. The revolutions per spot are one way to gage the cleaning effectiveness of a machine. Table 1 makes it clear that the present invention has substantially more revolutions per spot than these prior art scrubbers.

TABLE 1

| | Pad Size (sq in) | Maximum Pressure (lb) | PSI | RPM | Forward Speed (ft/s) | Rev/spot |
|---|---|---|---|---|---|---|
| Orbital Scrubber 14" × 18" | 252 | 90 | 0.4 | 2250 | 3 | 15 |
| Orbital Scrubber 14" × 24" | 336 | 150 | 0.4 | 2250 | 4 | 10 |
| PRIOR ART BP-18 Orbital 6" × 18" | 108 | 45 | 0.4 | 1600 | 2 | 5 |
| PRIOR ART Encore 17 Rotary 17" Diameter | 201 | 90 | 0.4 | 200 | 3 | 2 |
| PRIOR ART Encore 2426 Rotary 13" Diameter | 224 | 150 | 0.7 | 200 | 4 | 1 |

Some of the data has been rounded up or down to simplify the presentation.

Table 2 below compares cleaning solution flow rates in various prior art scrubbers and the present invention. Solution flow rate will determine the solution run time of the scrubber. Table 2 demonstrates that the present invention with various sized cleaning elements has a lower flow rate and thus greater solution run time than these prior art scrubbers. Another bench mark of comparison is U.S. Pat. No. 6,585,827 assigned to Tennant Company. This patent states as follows: "One limitation of prior art scrubbers has been a relatively limited operational run time. For a typical scrubber with a 32 inch wide scrub swath and 30 gallon solution tank, the solution distribution rate varies between 0.5 GPM to 1.0 GPM. Run time based on solution capacity is between approximately 30-40 minutes."

The solution flow rate of the present invention is between about 0.008 gal./in./min to about 0.017 gal./in./min. Since flow is measured in gallons/minutes it can vary depending on the size of the floor scrubber and width of the scrub head. Therefore, flow expressed in gallons/minute is not a good indication of the efficiency of a floor scrubber. Historically, very little attention has been given to the optimal amount of solution needed to clean a floor Measuring the usage of solution in gallons/inch/minute gives a more accurate measure of solution use efficiency. The number of gallons of solution being used per each inch of scrub head width in one minute can be used as a measure of efficiency for any width of scrub head or any size scrubber.

It has been determined through testing that the optimum usage of solution for an orbital scrubber is about 0.008 to about 0.017 gallons per inch of head width in one minute. A heavily soiled floor may require up to about 0.017 gal/in/min and a lightly soiled floor may require only about 0.008 gal./in./min. Therefore, for any width of scrub head you will simply need to multiply this solution flow range times the scrub head width in inches to obtain the optimum amount of flow in gallons/min for any size scrubber. This technique eliminates any guess work as to how much solution should be used by any scrubber with any size width scrub head.

To calculate the maximum necessary solution flow rate for the present invention in the 18" width, multiply the full flow setting of 0.017 gal/in/min times the brush head width of 18" to get the flow rate of 0.31 Gal/min. To calculate the maximum necessary solution flow rate for the present invention in the 24" width, multiply the full flow setting of 0.017 gal/in/min times the brush head width of 24" to get the flow rate of 0.40 Gal/min. To calculate the maximum necessary solution flow rate for the present invention in the 28" width, multiply the full flow setting of 0.017 gal/in/min times the brush head width of 28" to get the flow rate of 0.48 Gal/min. To calculate the maximum necessary solution flow rate for the present invention in the 32" width, multiply the full flow setting of 0.017 gal/in/min times the brush head width of 32" to get the flow rate of 0.55 Gal/min. The following table compares the flow rates and usage rates for various theoretical embodiments of the present invention with various prior art devices.

TABLE 2

| | Cleaning Area (sq/ft/min) | Usage Rate (Gal/in/min) | Flow Rate (Gal/min) | Tank (gal) | Solution Run Time (min) | Total Area Cleaned (sq ft) |
|---|---|---|---|---|---|---|
| Orbital Scrubber 14" × 18" Full flow setting | 259 | 0.017 | 0.31 | 11 | 77 | 19985 |
| Orbital Scrubber 14" × 24" Full flow setting | 515 | 0.017 | 0.40 | 20 | 50 | 25980 |
| Orbital 14" × 28" Full flow setting | 601 | 0.017 | 0.48 | 20 | 42 | 25259 |
| Orbital Scrubber 14" × 32" Full flow setting | 726 | 0.017 | 0.55 | 30 | 57 | 41219 |
| PRIOR ART BP-18 Full flow setting | 216 | 0.059 | 1.1 | 5 | 4.7 | 1022 |
| PRIOR ART Encore 17 | 245 | 0.010 | 0.18 | 11 | 61 | 14989 |

TABLE 2-continued

| | Cleaning Area (sq/ft/min) | Usage Rate (Gal/in/min) | Flow Rate (Gal/min) | Tank (gal) | Solution Run Time (min) | Total Area Cleaned (sq ft) |
|---|---|---|---|---|---|---|
| Rotary 17" Diameter Full flow setting PRIOR ART Encore 2426 Rotary 26" Diameter Full flow setting | 558 | 0.028 | 0.74 | 20 | 27 | 15078 |

Figure 10:
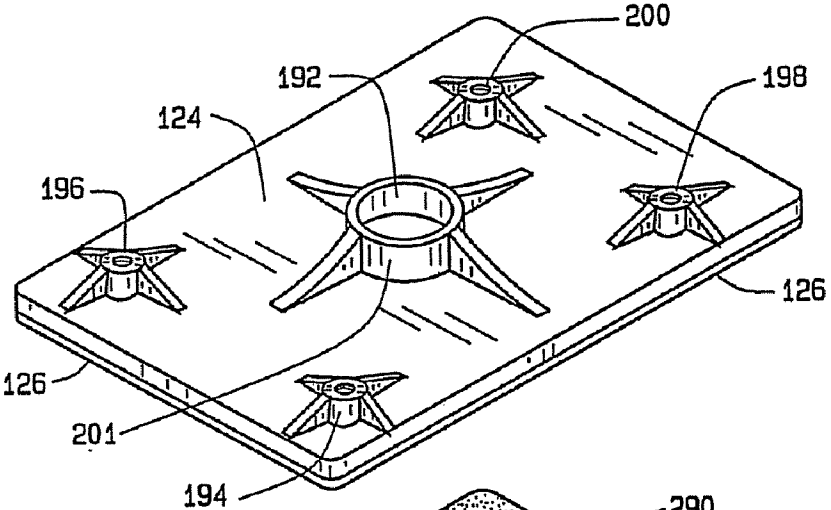
FIG. 10 is a perspective view of a flexible pad driver and a removable cleaning brush.
Figure 10:
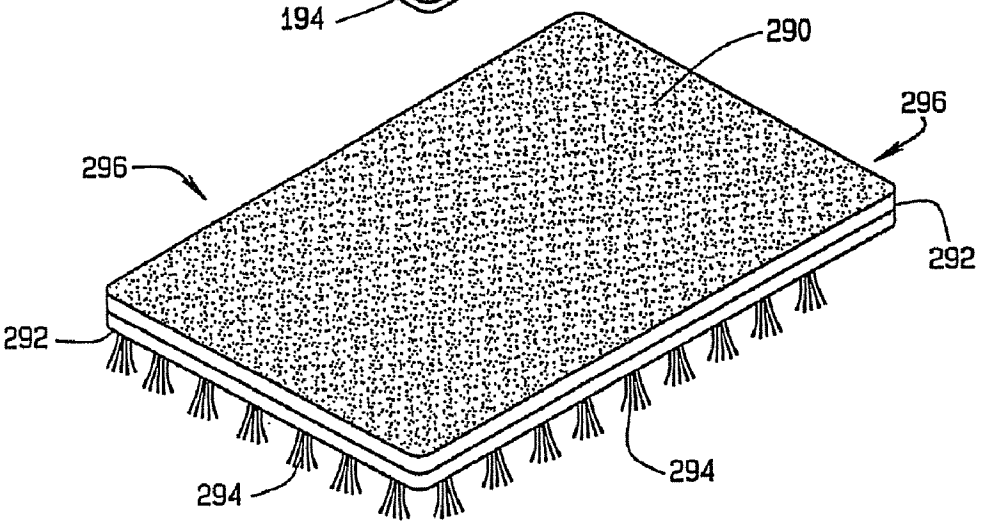

FIG. 10 is a perspective view of a flexible pad driver 124 and a removable cleaning brush generally identified by the numeral 296. The flexible pad driver 124 has a connecting means 126, which in this figure is a hook and loop device. The removable cleaning brush 296 includes a flexible plastic or nylon sheet 292 with bristles 294 extending from one side and a pad 290 located on the opposite side. The pad 290 removably engages the hook and loop device or other connecting elements 126 on the pad driver 124. The removable cleaning brush 296 and the removable cleaning pad 117 are both referred to as cleaning elements 116 in this application.

Those skilled in the art know that prior art rotary motion scrubbers use both brushes and pads as cleaning elements. To the best of applicant's knowledge, the pad drivers used in prior art rotary motion scrubbers, like the Encore series, are rigid for both brushes and cleaning pads. The present invention uses a flexible pad driver 124 for both removable cleaning pads 117 and removable cleaning brushes 296 of FIG. 10.

The present invention will give future-designers of scrubbers for hard floor surfaces a number of design options, not previously available. With prior art rotary motion scrubbers, battery run time is not the primary limiting factor in scrubber design; instead, solution run time is the limiting factor. In other words, the operator must make several tank refills before the battery run time ends. In a perfect world, solution run time would equal battery run time, but no scrubber presently has achieved this lofty goal including the present invention. However, the present invention has reduced the number of tank refills to a lower level than any current rotary motion scrubber, including the Tennant Fast foam machine. This advantage has been achieved due to the low cleaning solution consumption rate of the present invention.

In addition, the present invention has reduced the consumption of electrical energy, which will also give future designers a number of options. For example, one brush motor will be all that is required on the present invention even in larger sizes. Some conventional rotary scrubbers use two brush motors on larger scrubbers. This reduces costs and may allow designers to reduce the battery size, if desired. Smaller batteries may also allow for enlarged solution and recovery tanks. The reduction in consumption of electrical energy has been achieved by the high speed orbital motion of the flexible pad driver along with other design features discussed herein.

The present invention can be designed with various features as discussed above. However, applicant has designed three theoretical embodiments described below that produce many of the advantages discussed herein.

TABLE 3

| ORBITAL SCRUBBERS SPECIFICATIONS | | | |
|---|---|---|---|
| Cleaning Width | 18" | 24" | 32" |
| Pad Size | 14" × 18" | 14" × 24" | 13" × 32" |
| Pad Size in square inches | 252 | 336 | 448 |
| Maximum Load | 90 lbs. | 150 lbs. | 220 lbs. |
| PSI | 0.36 | 0.45 | 0.49 |
| Brush Speed | 2250 RPM | 2250 | 2250 |
| Forward Speed | 2.88 Ft./Sec | 4.29 | 4.3 |
| Rev./Spot | 15 | 10.2 | 10.2 |
| Orbit Diameter | ¼" | ¼" | ¼" |
| Power Supply | (2)12V130AH WET | (2)12V130AH WET (2)12V330AH WET | (2)12V330AH WET (2)12V370AH WET |
| Brush Motor | ¾ HP | ¾ HP | ¾ HP |
| Traction Motor | ⅓ HP | ½ HP | ½ HP |
| Vacuum Motor | ¾ HP | ¾ HP | ¾ HP |
| Battery Run Time | 156 min. | 396 min. | 404 min. |
| Flow (full solution setting) | 0.14 gal/min | 0.40 | 0.53 |
| Usage (full solution setting) | .017 (gal/in/min) | .0165 | 0.017 |
| Tank Size | 11 gal. | 20 gal. | 30 gal. |
| Solution Run Time | 77 min. | 50 min. | 57 min. |
| Total Area Cleaned | 19,985 sq. ft. | 25,980 sq. ft. | 38,970 sq. ft. |
| Weight w/ Batteries | 342 | 871 | 1038 |
| Weight w/ Batteries and Solution | 419 | 1011 | 1248 |

The orbital scrubber 100 uses a cleaning head assembly 102 that has four upper vibration dampening elements 134, 136, 138 and 140 and four lower vibration dampening elements 142, 144, 146 and 148, best seen in FIG. 8. These upper and lower vibration dampening elements are subject to vertical stresses when the cleaning head assembly 102 is lifted off the floor and horizontal stresses when the cleaning head assembly unintentionally bumps into a door jam, wall or other stationary object. If the upper vibration dampening elements 134-140 completely fail, the motor 128 and all components below the motor, including the motor mounting plate 340, the flexible pad driver 308 and the cleaning pad 116 will fall off the orbital scrubber 100 and only be attached by the solution conduit 216 and wires, not shown.

An improved cleaning head assembly 302, best seen in FIGS. 11-14, has been developed which includes at least one and preferably two stabilizer elements 304 and 306 to reduce these stresses on the upper vibration dampening elements 134, 136, 138 and 140. The exact number of upper and lower vibration elements may vary depending on the size and type of scrubber and other factors. The motor 128 and all components below the motor, including the motor mounting plate 340, the flexible pad driver 308 and the cleaning pad 116 will not fall off the scrubber 100, even if the upper vibration dampening elements completely fail in the improved cleaning head assembly 302.

Figure 27:
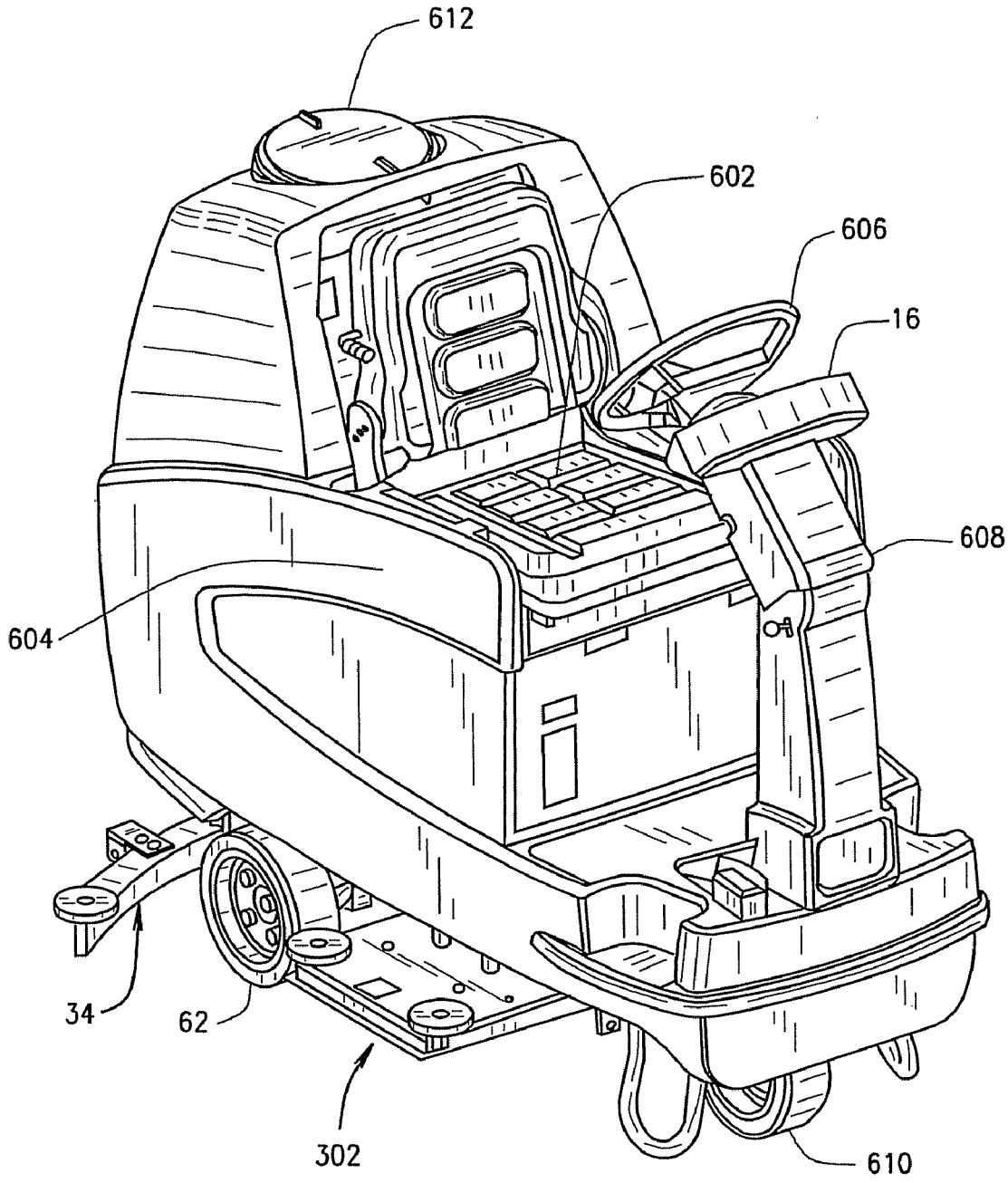
FIG. 27 is a perspective view of a rider type scrubber using an orbital cleaning head assembly with stabilizer elements.

The improved cleaning head assembly 302 is intended to be used with the orbital scrubber 100. The orbital scrubber 100 is referred to in the industry as a "walk behind" machine because the operator walks behind the scrubber as it moves across the floor. Other scrubbers are referred to in the industry as "riders" because the operator rides on the machine as it moves across the floor. A rider scrubber 600 is shown in FIG. 27. Those skilled in the art will recognize that the improved cleaning head assembly 302 may be used on "walk behind" type scrubbers like the scrubber 100 and/or "rider" type scrubbers like the scrubber 600. Several structural improvements have been made to the orbital scrubber 100, but many of the main components remain the same and for the sake of brevity will not be repeated in detail. For example, the means for imparting orbital motion to the cleaning element are substantially the same as are the systems for delivery and pickup the cleaning solution 43. When a component is substantially the same in the cleaning head assembly 102 and the improved cleaning head assembly 302, such components will be identified by the same number. For example, the cleaning element 116 is the same in both designs and the upper vibration dampening elements, 134, 136, 138 and 140 are the same in both designs. There are also a few structural differences between the cleaning head assembly 102 and the improved cleaning head assembly 302, including the addition of the stabilizer elements 304 and 306, a multi-part pad driver 308, best seen in FIG. 22, among others discussed in detail below.

Any structural improvements in the orbital scrubber 100 will be discussed in detail, below. For example, there are a few differences in the system for lifting the cleaning head assembly 302. Specifically, the improved cleaning head assembly 302 is raised and lowered by a pair of L-shaped lift arms 354 and 356. These L-shaped lift arms are pivotally mounted to a pair of lift brackets 368 and 370 which are a part of the improved cleaning head assembly 302.

Referring now to FIGS. 11, 12, 13 and 14, the improved cleaning head assembly 302 is shown in various views in conjunction with the orbital scrubber 100. The cleaning head assembly 302 has at least one stabilizer element 304 and preferably a second 306 to reduce stress on the upper vibration damping elements, 134, 136, 138 and 140, best seen in FIG. 13. The present invention does not reduce stress on the lower vibration dampening elements, 324, 326, 328, 330, 332, 334, 336 and 338.

Figure 11:
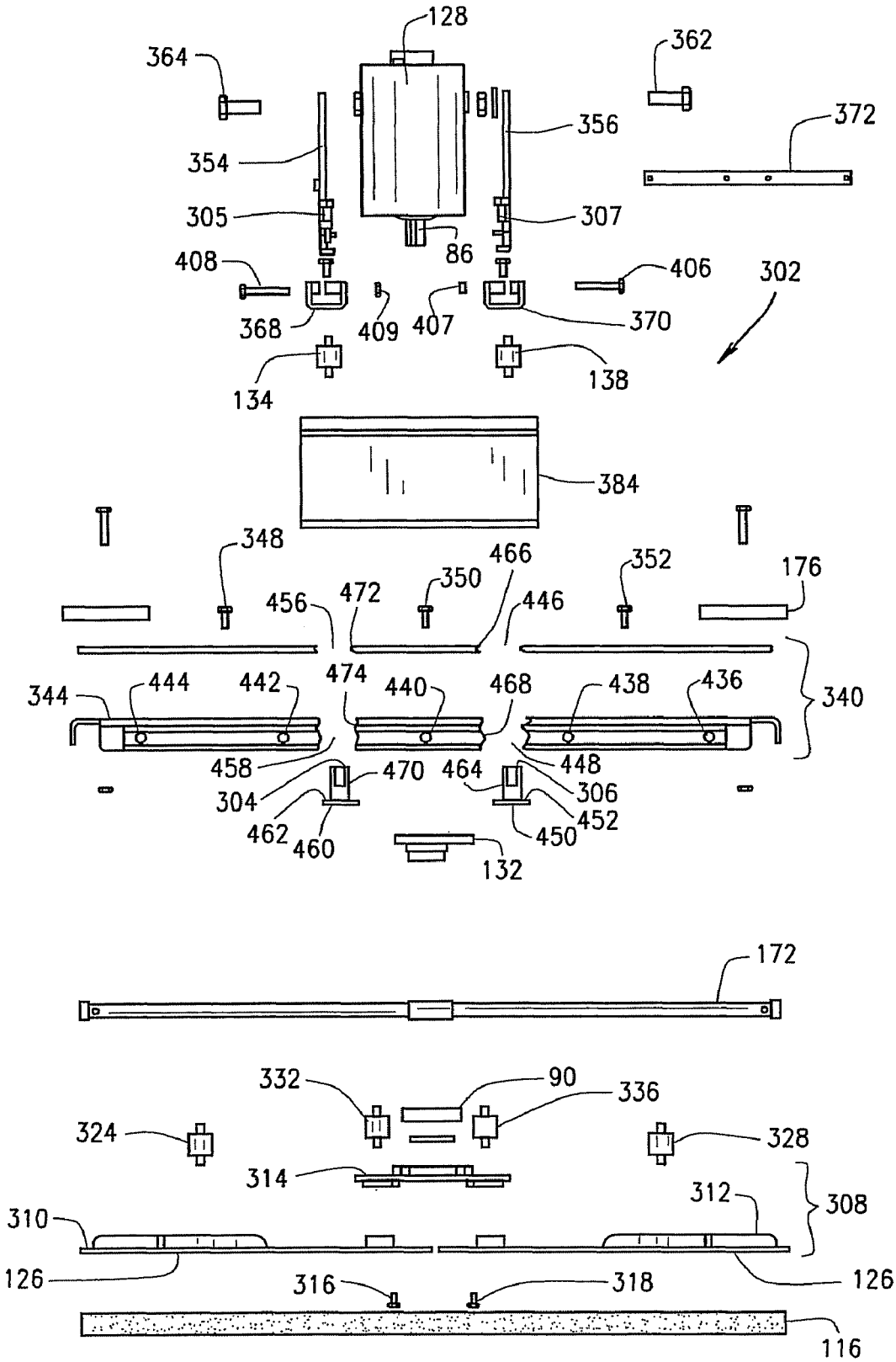
FIG. 11 is an exploded front view of the improved cleaning head assembly.
Figure 25:
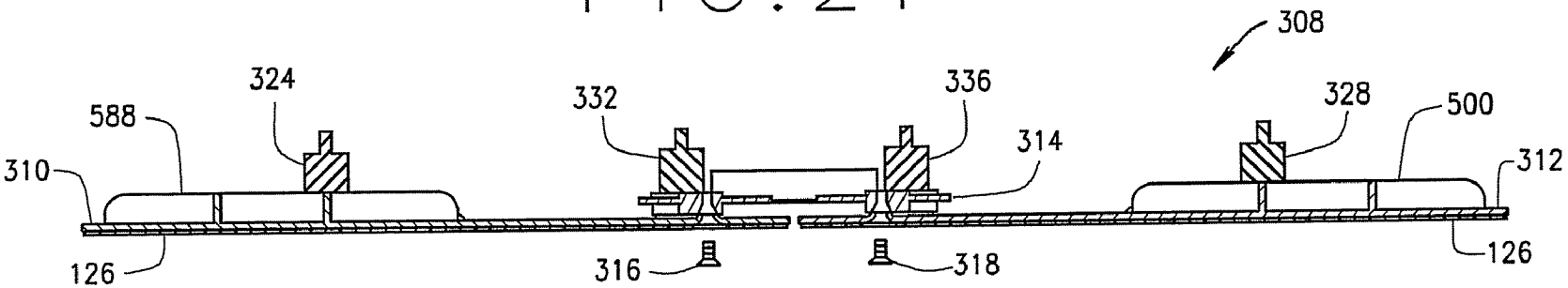
FIG. 25 is a section view of the assembled multi-part flexible pad driver along the line 25-25 of FIG. 23.

The cleaning element 116 is removably attached to the flexible pad driver by an attaching means 126. The flexible pad driver 308 can be produced as a single piece 124 as shown in FIG. 4 or the flexible pad driver can be produced in several pieces 308 as shown in FIG. 11, as a matter of manufacturing convenience. The flexible multi-part pad driver 308 is produced in three pieces that are screwed together to form a single operational component. Depending on the size of the flexible pad driver, it may be easier and more economical to produce the flexible pad driver in three pieces, the left wing 310, the right ring 312 and the central element 314. Front left screw 316, front right screw 318, rear left screw 320 and rear right screw 322 connect the flexible driver 308 into a single component as best seen in FIG. 25.

Figure 14:
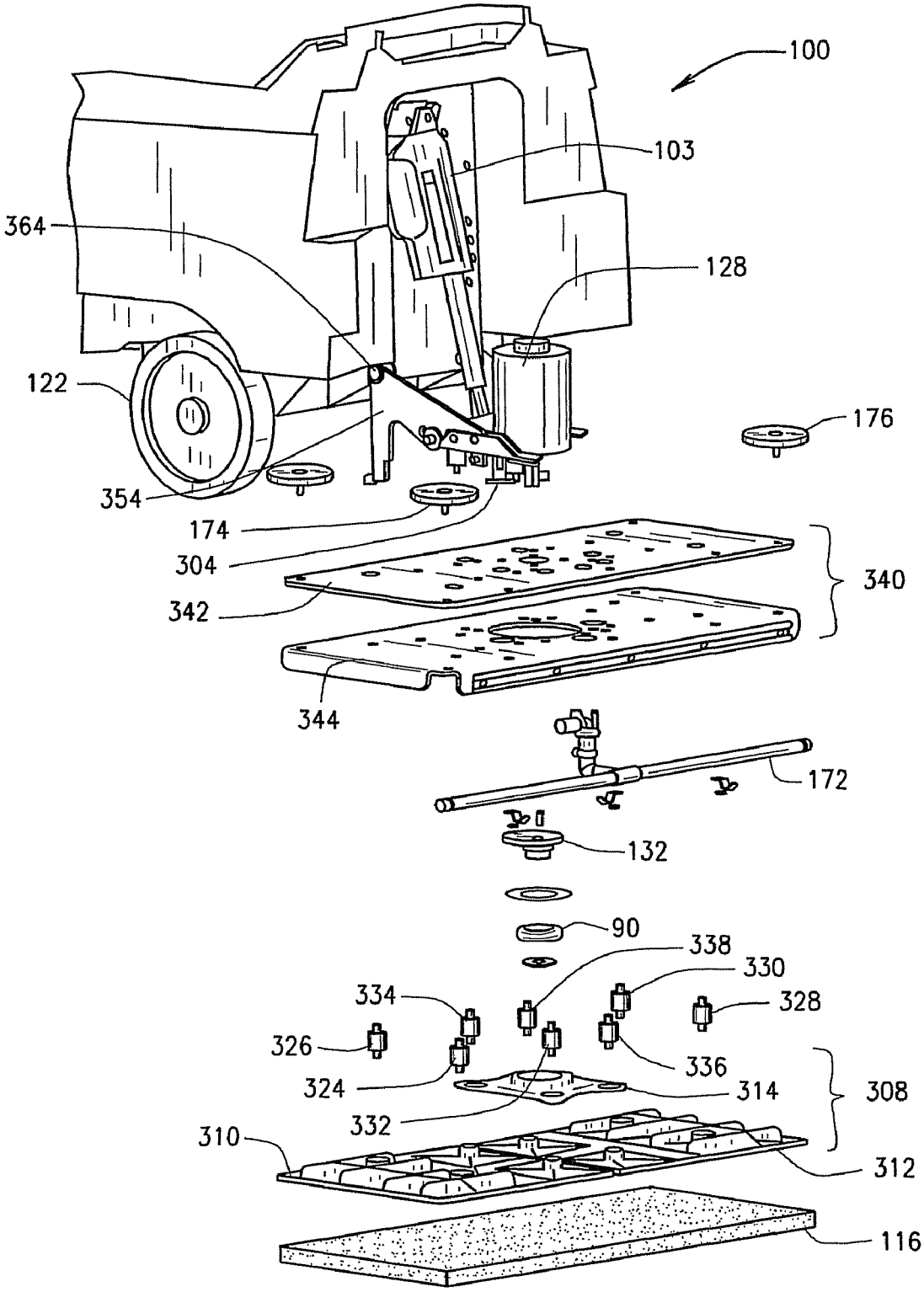
FIG. 14 is a front view of the orbital scrubber with the improved cleaning head assembly, portions of which have been exploded.
Figure 22:
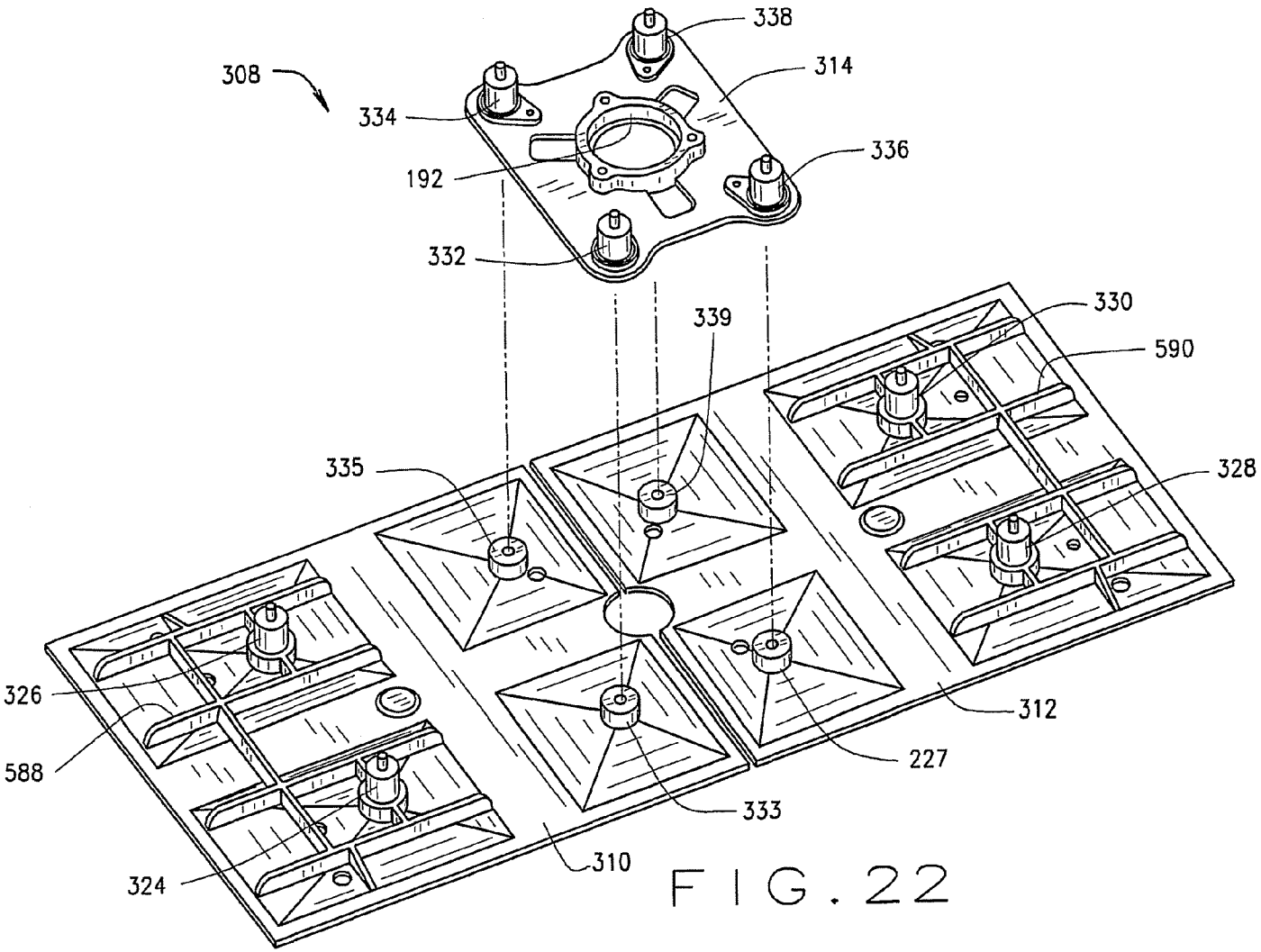
FIG. 22 is a perspective view of the multi-part flexible pad driver, disassembled.

The left wing 310 of the flexible pad driver 308 receives a first lower vibration dampening element 324 and a second lower vibration dampening element 326, best see in FIG. 14. The number and placement of the vibration dampening elements is discretionary, depending on the size of the motor 128, the eccentric cam 132 and the overall size of the machine. The right wing 312 receives a third vibration dampening element 328 and a fourth vibration dampening element 330. The central element 314 defines a plurality of apertures so the central element 314 can slide over a fifth vibration dampening element 332, a sixth vibration dampening element 334, a seventh vibration dampening element 336 and an eight vibration dampening element 338 as best seen in FIG. 22. Vibration dampening element 332, and 334 threadably engages the left wing 310; vibration dampening elements 336 and 338 threadably engage the right wing 312.

Figure 12:
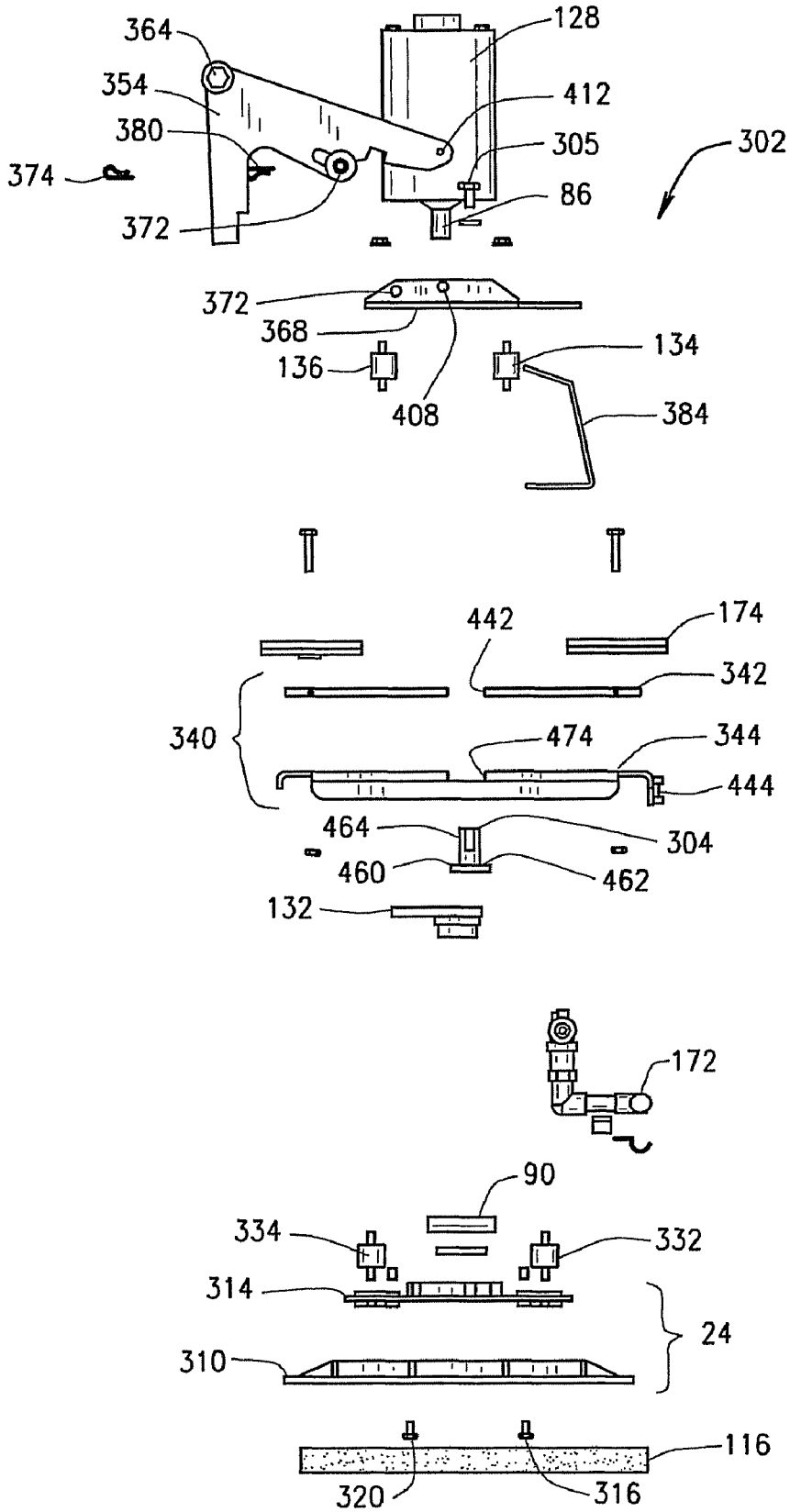
FIG. 12 is and exploded side view of the improved cleaning head assembly.
Figure 13:
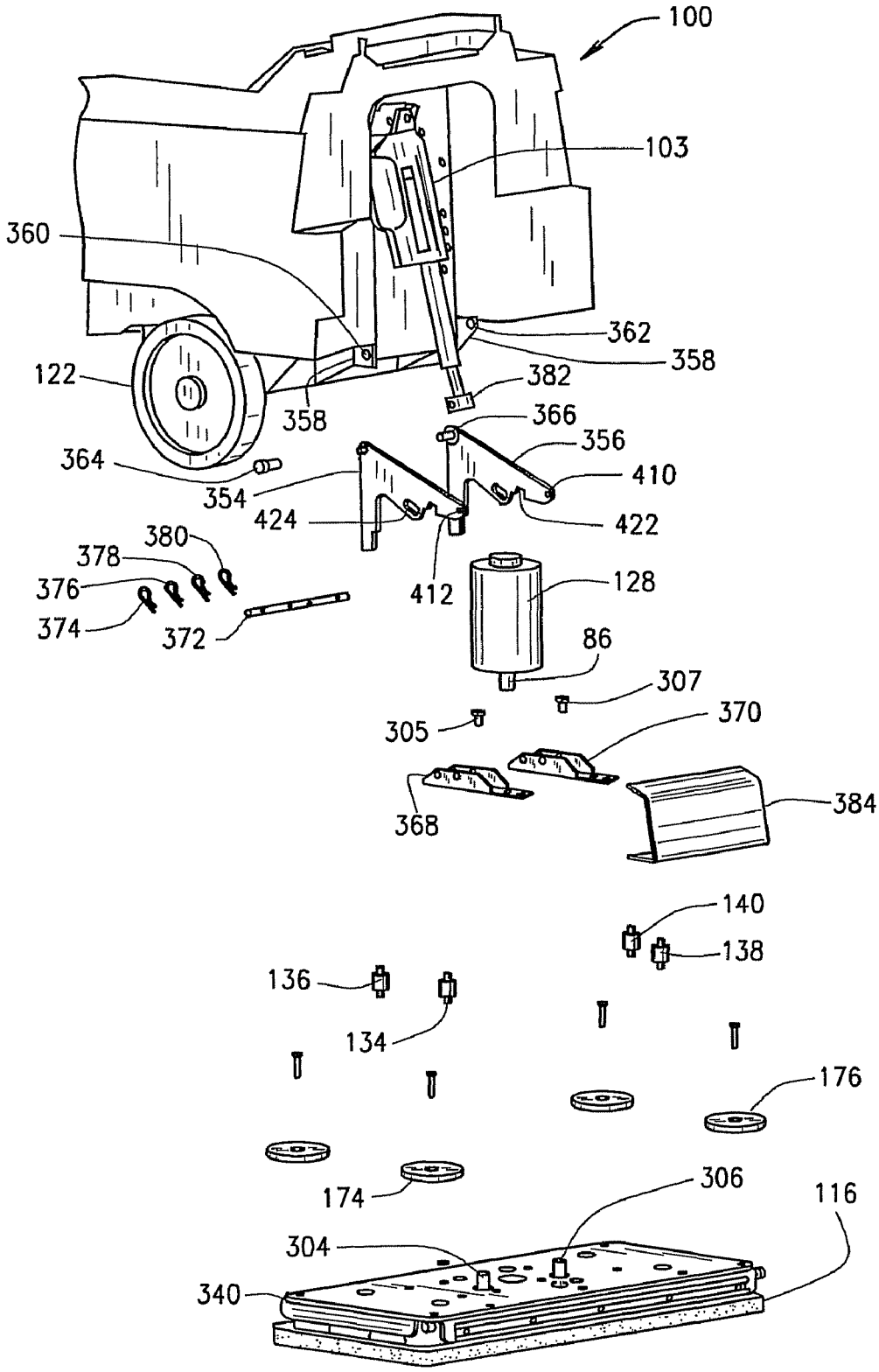
FIG. 13 is a front view of the orbital scrubber with the improved cleaning head assembly, portions of which have been exploded.

The brush motor 128 has a protruding drive shaft 86 that is operatively connected to the eccentric cam 132 which rotates in a raceway 90. The raceway engages a journal 192 in the central element 314 of the flexible pad driver 308. When the brush motor 128 is operating, the eccentric cam imparts orbital motion to the pad driver 308 and the cleaning element 116. For this reason, this machine is called an orbital scrubber. The brush motor may be attached to a motor mounting plate 130 as shown in FIG. 4 or a multi-piece motor mounting plate 340 as shown in FIGS. 11, 12 and 13. The multi-piece motor mounting plate 340 includes an upper plate 342 and a lower plate 344 held together by screws, such as 348, 350 and 352 shown in FIG. 12. Use of a multi-piece motor mounting plate 340 allow more downward load to be placed on the cleaning element 116. The term downward load is synonymous with the term head pressure.

The left L-shaped lift arm 354 and the right L-shaped lift arm 356 are pivotally connected to a frame 358 on the scrubber 100. Movement up and down of the L-shaped lift arms is imparted by the variable actuator 103. The variable actuator can also impart an additional amount of downward force on the cleaning head assembly 302. The frame 358 has a left aperture 360 and a right aperture 362. Left bolt 364 passes through the left L-shaped lift arm and the left aperture in the frame. Right bolt 366 passes through the right L-shaped lift arm and the right aperture in the frame allowing the left and right L-shaped lift arms to be pivot mounted on the scrubber 100. Left L-shaped lift arm 354 is pivotally connected to left lift bracket 368 and right L-shaped lift arm 356 is pivotally connected a right lift bracket 370. Both left and right lift brackets are connected to the motor mounting plate 340. A pivot pin 372, best seen in FIG. 13, passes through apertures in left L-shaped lift arm 354 and apertures in the right L-shaped lift arm 356. The pivot pin is secured in place by first clip 374, second clip 376, third clip 378 and fourth clip 380. A yoke 382 on the actuator 103 engages the pivot pin 372. In this fashion, the actuator can move the improved cleaning head assembly from a raised position with the cleaning element 116 out of contact with the floor to a lowered position with the cleaning element 116 in contact with the floor for scrubbing. The actuator 103 is controlled by the operator of the machine from the control panel, not shown. A front guard 384 is connected to the motor mounting plate. The front guard 384 shown in FIGS. 11-13, is not shown in FIG. 14 to better illustrate the other components shown in FIG. 14.

Figure 15:
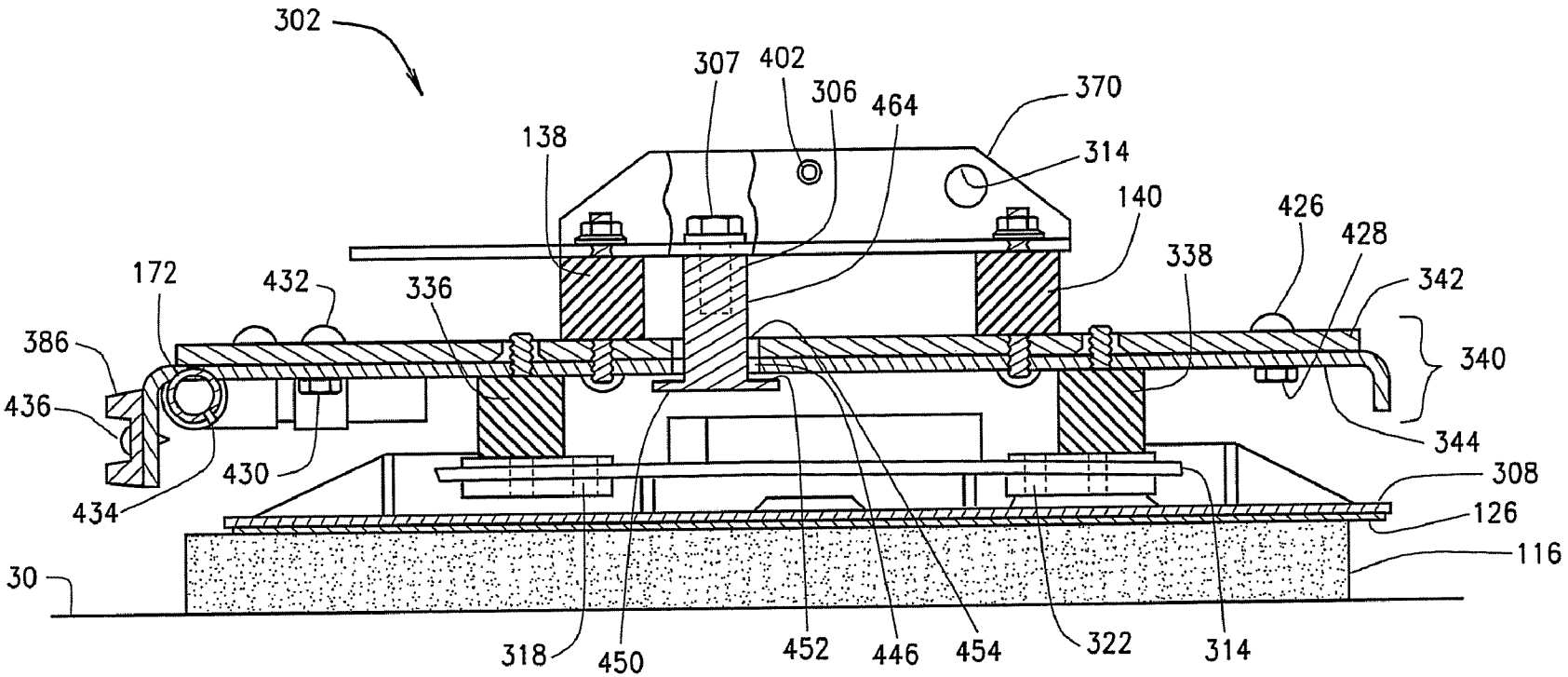
FIG. 15 is a side elevation view of the improved cleaning head assembly in a relaxed position with the cleaning pad resting on the floor.
Figure 15A:
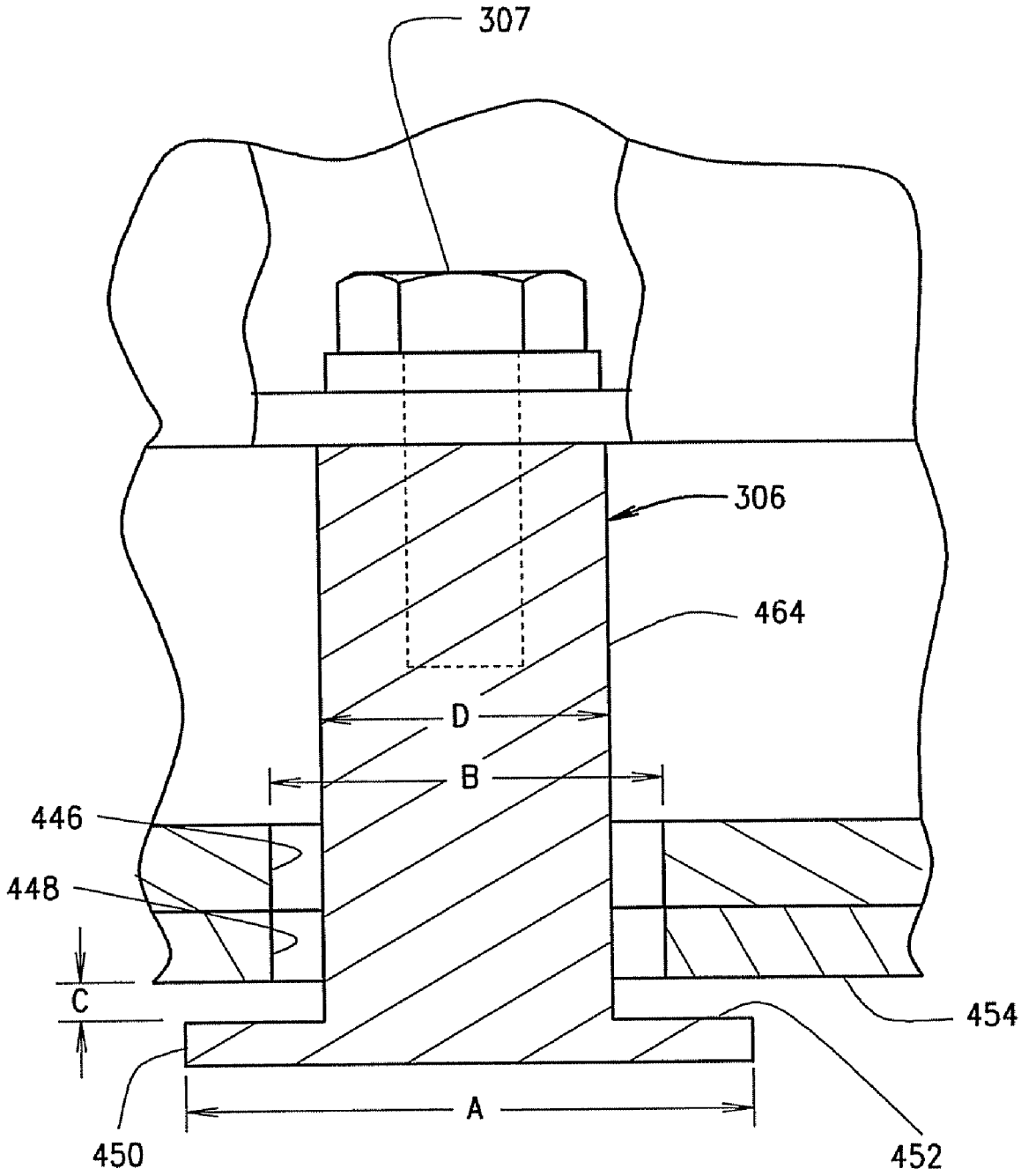
FIG. 15A is an exploded view of the right stabilizer element and surrounding components from FIG. 15.

Referring now to FIGS. 15, 15A, 16 and 17, a section view of a portion of the improved cleaning head assembly 302 with elongate stabilizer element 306 is shown. In prior designs, the upper vibration dampening elements, 134, 136, 138 and 140 may failed prematurely due to a) repeated lifting of the cleaning head assembly from the lower to the upper position and/or b) unintentional bumping of the cleaning head assembly into walls or door jams when it was in the upper position. The addition of stabilizer elements 304 and 306 should prevent and/or reduce premature failure of the upper vibration dampening elements. In FIG. 15 the right vibration dampening element 306 is connected to the right lift bracket 370 by bolt 307. In this view the cleaning element 116 is in contact with the floor 30. The upper vibration dampening elements 138 and 140 are in a relaxed position. The right stabilizer element 306 does not touch the motor mounting plate 340.

The right lift bracket 370 has an aperture 402 and left lift bracket 368 likewise has an aligned aperture 404. A bolt 406, shown in FIG. 11, passes through the aperture 402 in right lift bracket 370 and an aperture 410, shown in FIG. 13, in right L-shaped lift arm 356. The bolt 406 is secured by nut 407, thus pivotally connecting the right L-shaped lift arm to the right lift bracket. A bolt, 408, shown in FIG. 11, passes through an aperture 404 in the left lift bracket 368 and an aperture 412, shown in FIG. 13, in the in the left L-shaped lift arm 354. The bolt 408 is secured by a nut 409, thus pivotally connecting the left L-shaped lift arm to the left lift bracket.

Another aperture 370 is formed in right lift bracket 370 and the left lift bracket likewise has an axially aligned aperture 372. A bolt 418, better seen in FIG. 11, passes through the aperture 314 and is secured by a nut. The bolt 418 engages a notch 422, better seen in FIG. 13, in the right L-shaped lift arm 356. Another bolt 420, better seen in FIG. 11, engages a notch 424, better seen in FIG. 13, in the left L-shaped lift arm 354. The bolts 418 and 420 help keep the cleaning element in contact with the floor and if desired apply force from the actuator 103 to the cleaning head assembly.

The orbital scrubber can be adjusted by the operator to apply between about 130-170 pounds of down pressure or head pressure to the cleaning head assembly 302. A plurality of nuts and bolts secure the multi-part motor mounting plate 340 together. The multi-part motor mounting plate 340 includes the upper plate 342 which weighs about 30 pounds. The motor 128, the lower motor mounting plate 344, the flexible pad driver 308 and the other components in the cleaning head assembly weigh about 100 pounds. Therefore, the force of gravity will exert about 130 pounds of down pressure or head pressure on the cleaning head assembly 302. The variable actuator 103, better seen in FIG. 13 can be adjusted from about zero to about 40 pounds for the Boost® 32 inch scrubber. The actuator 103 is infinitely variable from about zero to about 40 pounds on this particular machine. So the head pressure can range from about 130 pounds when gravity alone is being exerted on the cleaning head assembly to about 170 pounds when the variable actuator adds additional down pressure to the cleaning head assembly 302. Other machines with different size cleaning head assemblies may require different amounts of head pressure. As previously mentioned the upper motor mounting plate 342 and the lower motor mounting plate are secured by a plurality of nuts and bolts, such as nut 426 and bolt 428, nut 430 and bolt 432 among others. The location and number of these nuts and bolts is a matter of manufacturing convenience.

The cleaning solution distribution tube 172 is connected to the bottom of the motor mounting plate. An aperture 434 is shown in the tube at the 5 o'clock position; a plurality of such apertures are formed in the cleaning solution distribution tube 172. Cleaning solution 43 flows through the solution distribution tube 172 and out the aperture 434, and others, not shown, to the cleaning pad 116 and/or the floor 30. A bumper 386 is attached to the front of the lower mounting plate 344 by a plurality of screws 436, 438, 440, 442 and 444. Screws 438-444 are better seen in FIG. 11.

An upper stabilizer aperture 446 is formed in the upper motor mounting plate 342 and a lower stabilizer aperture 448 is formed in the lower motor mounting plate 344. The upper stabilizer aperture 446 and the lower stabilizer aperture 448 are axially aligned and the inside diameter, indicated by the arrows B, of each of these stabilizer apertures is generally the same and larger than the outside diameter, indicated by the arrows D, of the right stabilizer element 306. The od, indicated by the arrows D, of the stabilizer element is about 0.75 inches in this embodiment and the id, indicated by the arrows B, of the apertures in the multi-part motor mounting plate is about 1.25 inches, in this embodiment. This limits the amount of horizontal displacement to about 0.25 inches in any direction, in this embodiment. Thus the maximum amount of horizontal stretch that can be applied to the upper vibration dampening element 138 and 140 is about 0.25 inches, in this embodiment. The amount of horizontal stretch will vary depending on manufacturing tolerances, the size, composition and number of the vibration dampening elements, the weight of the cleaning head assembly and the overall size of the machine. Therefore, the maximum amount of horizontal stretch may be more or less than the amount disclosed above depending on the aforementioned and other factors.

A stabilizer shoulder 450 is formed on the end of the right stabilizer element opposite the bolt 307. The outside diameter, indicated by the arrows A, of the shoulder 450 is wider than the inside diameter, indicated by the arrows B, of the apertures 446 and 448 so the stabilizer element 306 may lift the multi-piece motor mounting plate 340 when the lift bracket 370 is raised by the L-shaped lift arm 356. Therefore the approximate distance between the top surface 452 of the stabilizer shoulder 450 to the bottom surface 454 of the lower motor mounting plate 344 is about 0.13 inches (about ⅛ inch). Thus the maximum amount of vertical stretch that can be applied to the upper vibration dampening element 138 and 140 is about 0.13 inches (about ⅛ inch), in this embodiment. The amount of vertical stretch will vary depending on manufacturing tolerances, the size, composition and number of the vibration dampening elements, the weight of the cleaning head assembly and the overall size of the machine. Therefore, the maximum amount of vertical stretch may be more or less than the amount disclosed above depending on the aforementioned and other factors. The left stabilizer element 304 is similarly designed and arranged to limit horizontal and vertical stresses on the upper vibration dampening elements.

In FIG. 15 the stabilizer element 306 is bolted to the lift bracket 370 and the free end passes through apertures in the motor mounting plate 340. Those skilled in the art will recognize that the configuration of the stabilizer element 306 and bolt 307 could easily be inverted, yet achieve the intended effect. In an inverted arrangement which is within the scope of this invention, the stabilizer element 306 could be bolted to the motor mounting plate 340 and the opposing free end with the right stabilizer shoulder 450 could pass through apertures in the lift bracket 370. Likewise those skilled in the art will recognize that the left stabilizer 304 could easily be inverted, yet achieve the intended effect.

Figure 16:
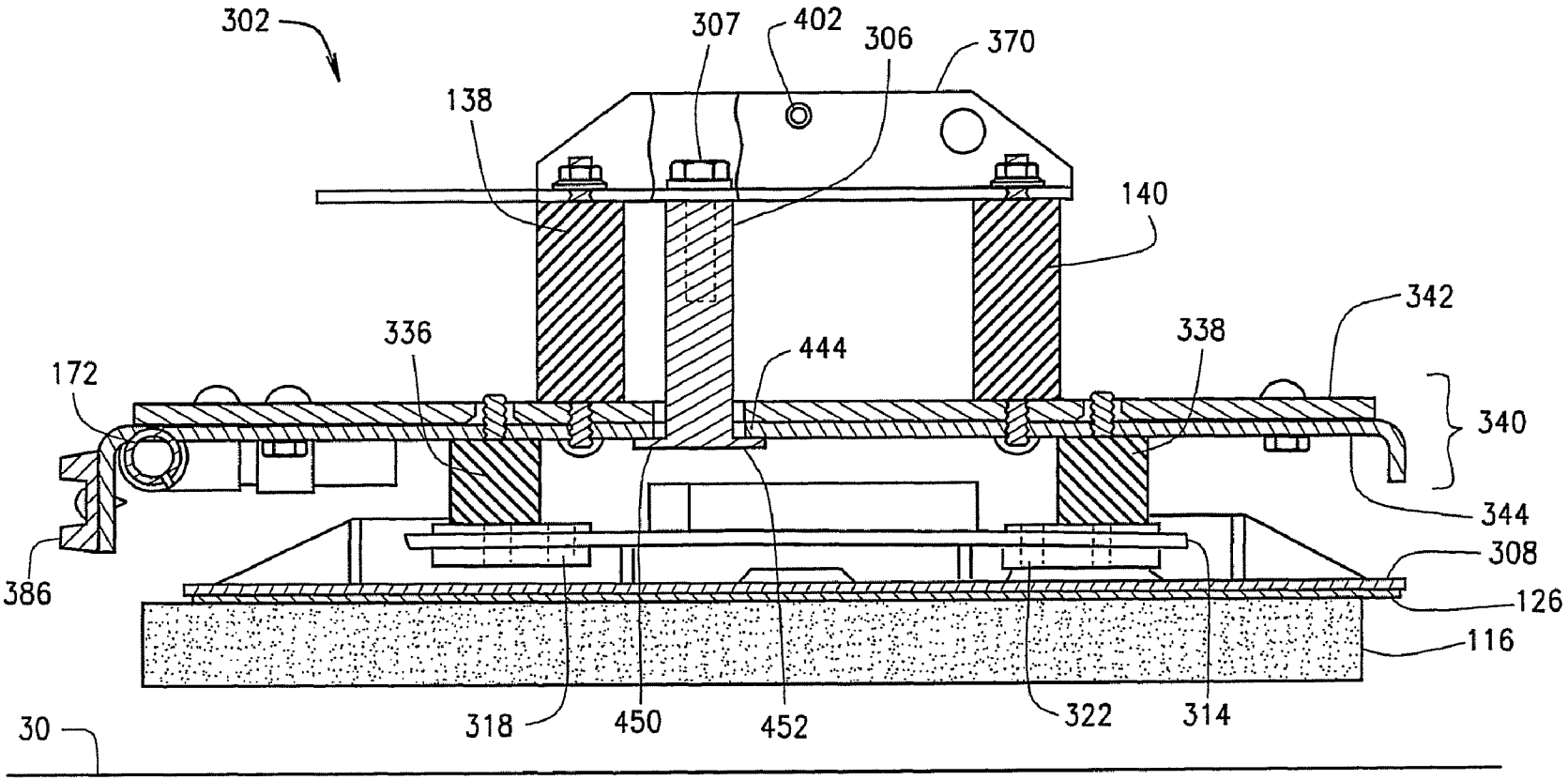
FIG. 16 is a side elevation view of the improved cleaning head assembly in a strained position with the cleaning pad off the floor. The vibration dampening elements and the stabilizer pin have been elongated for illustrative purposes.

FIG. 16 is a section view similar to FIG. 15, except the cleaning head assembly 302 has been raised and the cleaning element 116 has been raised out of contact with the surface of the floor 30. This is sometimes referred to as the transport position. The length of the vibration dampening elements 138 and 140 and the length of the right stabilization element 306 in FIG. 16 has been intentionally lengthened for purposes of illustration. The right stabilization element 306 is typically made from steel or some other rigid material and cannot be elongated in actuality. Again this is an illustration demonstrating that the right stabilizer pin limits the amount of vertical stretch that can be exerted on the upper vibration elements, 138, 140, 142 and 144. The top surface 452 of the right stabilizer shoulder 450 is in contact with the bottom surface 454 of the lower motor mounting plate 344, thus raising the multi-part motor mounting plate 344, the three piece flexible pad driver 308 and the cleaning element 116. The upper vibration dampening elements 138 and 140 are shown in elongated fashion to illustrate that they stretch somewhat when the cleaning head assembly 302 is raised from the floor. The lower vibration dampening elements are also subject to vertical and horizontal stresses, but because there are twice as many of the lower vibration dampening elements as the upper vibration dampening elements, the lower elements are less likely to fail. Therefore the present invention is designed solely to reduce stresses to the upper vibration dampening elements, 134, 136, 138 and 140, not the lower vibration dampening elements 324, 326, 238, 330, 332, 334, 336 and 338.

Figure 17:
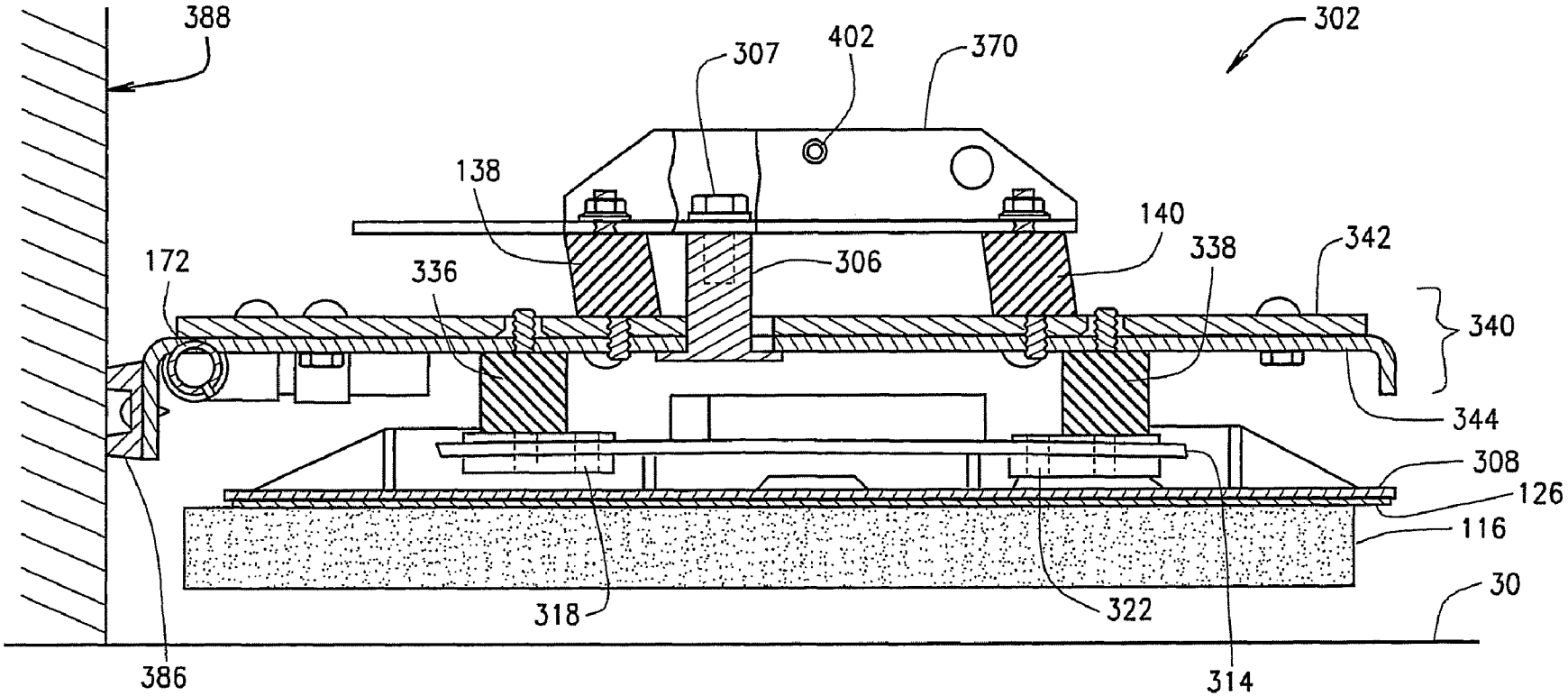
FIG. 17 is a side elevation view of the improved cleaning head assembly in a strained position with the cleaning pad off the floor.

FIG. 17 is a section view of the cleaning head assembly 302, with the cleaning element 116 raised from the floor surface 30. In this figure, the bumper 336 has inadvertently run in to a wall 388. As a result of this collision the cleaning head assembly 302 is thrust away from the wall and the upper vibration dampening elements, 138 and 140 are jarred horizontally. However, the left stabilizer element 306 limits the amount of horizontal movement that can be placed on the upper vibration dampening elements 138 and 140 to about 0.25 inch in any direction. Specifically the outside surface 464 of right stabilizer element 306 contacts the inside surface 466 of the aperture in the upper motor mounting plate 342 and the inside surface 468 of the aperture in the lower mounting plate 344. The left stabilizer element 304 limits the amount of horizontal movement that can be placed on the upper vibration dampening elements 134 and 136. Specifically the outside surface 470 of left stabilizer element 304 contacts the inside surface 472 of the aperture in the upper motor mounting plate 342 and the inside surface 474 of the aperture in the lower mounting plate 344. This contact between the stabilizer element and the apertures in the multi-part motor mounting plate limits the amount of horizontal movement that can be placed on the upper vibration dampening elements. The od of the stabilizer element is about 0.75 inches and the id of the apertures in the multi-part motor mounting plate is about 1.25 inches. This limits the amount of horizontal movement to about 0.25 inches in any direction. However, other machines of different size with different kinds of vibration dampening elements may have stabilizer elements of different sizes and accordingly the apertures in the multi-part motor mounting plate may also vary.

The term "cleaning head assembly 302" as used in the claims of this application includes everything between the motor 128 and the cleaning element 116 plus the right and left lift brackets 370 and 368 and the stabilizer elements 304 and 306. The term cleaning head assembly 302 does not include the left L-shaped lift arm 354 and the right L-shaped lift arm 356. The term cleaning head assembly as used in the claims of this patent application specifically includes among other components, the right lift bracket 370 and the right stabilizer element 306, the left lift bracket 368 and the left stabilizer element 304, the motor 128, the motor mounting plate 340, the upper vibration dampening elements 134, 136, 138 and 140, the flexible multi-piece pad driver 308, the lower vibration dampening elements 324, 326, 328, 330, 332, 334, 336, and 338, the cleaning element 116.

The stabilizer elements 304 and 306 should reduce and/or prevent vertical and horizontal stresses to the upper vibration dampening elements. Using the present invention, even if the upper vibration dampening elements 134, 135, 138 and 140 fail, the motor, pad driver and cleaning element will not fall away from the orbital scrubber 100 because of the stabilizer elements.

Figure 18:
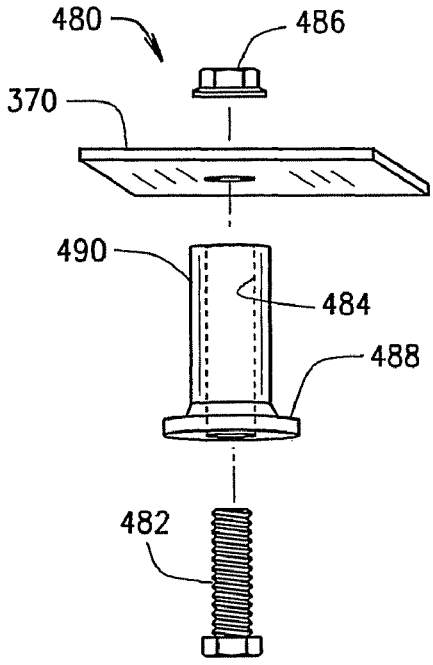
FIG. 18 is a partial perspective view of a first alternative embodiment of the stabilizer pin.

Referring now to FIGS. 18-21, alternative embodiments of the stabilizer element are shown. The first alternative embodiment of the stabilizer element 480 is shown in FIG. 18. A bolt 492 passes through the hollow core 484 of the stabilizer element 480 and an aperture 485 in the right lift bracket 370 and is secured by nut 486. The stabilizer element 488 has an angled shoulder 488 to engage the lower motor mounting plate and minimize vertical stress on the upper vibration dampening elements 134, 136, 138 and 140, better seen in the following figures. The outside surface of the stabilizer element 480 contacts the inside surface 466 of the aperture in the upper motor mounting plate and the inside surface of the aperture in the lower motor mounting plate to limit horizontal stress on the upper vibration dampening elements, 134, 136, 136 and 140, better seen in the following figures.

Figure 19:
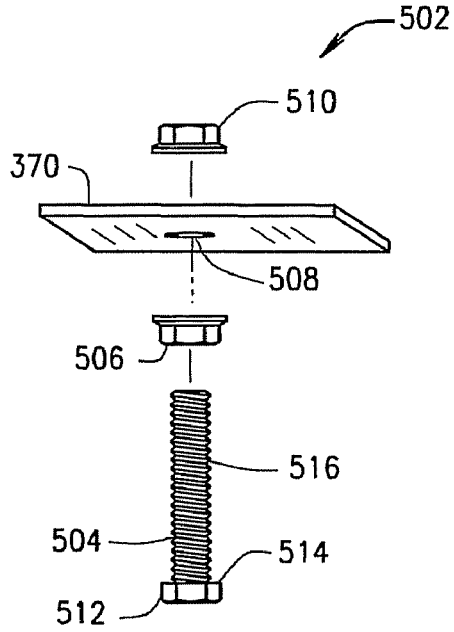
FIG. 19 is a partial perspective view of a second alternative embodiment of the stabilizer pin.

The second alternative embodiment of the stabilizer element 502 is shown in FIG. 19. A bolt 504 threadably engages a nut 506 and passes through an aperture 508 in the right lift bracket 370. Another nut 510 secures the bold 504 to the right lift bracket 370. The stabilizer element 502 has a shoulder 512 that forms an upper surface 514 to engage the lower surface of the lower motor mounting plate and thus limit the vertical stresses that can be applied to the upper vibration dampening elements 138 and 140. A left stabilizer element 518, not shown, is identical to 502 and is placed in the left lift bracket 368 to limit vertical stresses in the other vibration dampening elements 134 and 136. The left stabilizer element 518, not shown, has an outside surface that engages the inside surfaces of the apertures in the upper and lower motor mounting plates to limit horizontal stresses on the upper vibration dampening elements 134 and 136.

Figure 20:
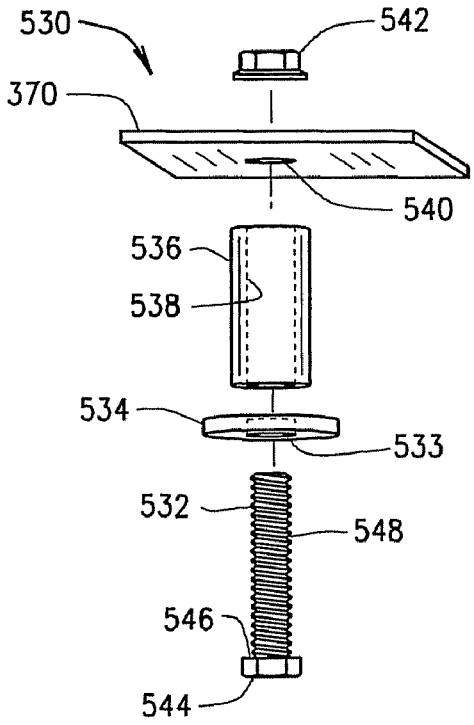
FIG. 20 is a partial perspective view of a third alternative embodiment of the stabilizer pin.

A third alternative embodiment 530 of the stabilizer element is shown in FIG. 20. A bolt 532 passes through a hole 533 in washer 534. The bolt 532 also passes through the hollow core 538 of sleeve 536 and the aperture 540 in right lift bracket 370. The right stabilizer element 530 is secured to the right lift bracket by a nut 542. The bold 532 forms a shoulder 544 on the end opposite the nut 542. The shoulder 544 defines an upper surface 546 to engage the lower surface of the lower motor mounting plate to limit vertical stresses on the upper vibration dampening elements, 138 and 140. The bolt 532 defines an outside surface 548 to engage the inside surfaces of the apertures in the upper and lower motor mounting plates to limit horizontal stresses on the vibration dampening elements 138 and 140. A left stabilizer element 550, not shown, is identical in all respects to stabilizer element 530 and is secured in similar fashion to the left lift bracket 368 to limit the vertical and horizontal stresses imparted to other upper vibration dampening elements 134 and 136.

Figure 21:
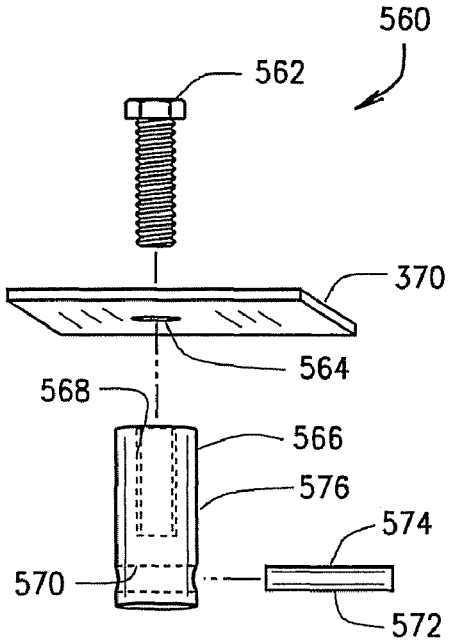

A fourth alternative stabilizer element 560 is shown in FIG. 21. A bolt 562 passes through an aperture 564 in the right lift bracket 370 and threadably engages a sleeve 566. The sleeve has a threaded receptacle 568 to threadably engage the bolt 562. On one end of the sleeve is a transverse hole 570 sized and arranged to receive a transverse pin 572. The pin is secured in the hole 570 by any suitable securing means such as welding. The pin 572 defines a top surface 574 which engages the lower surface of the lower motor mounting plate 344. In this fashion, the stabilizer element 560 limits the amount of vertical stretch on the upper vibration dampening elements 138 and 140. A left stabilizer element 578, not shown but identical to the stabilizer element 560 engages the left lift bracket 368 to limit the amount of vertical stretch on the upper vibration dampening elements 134 and 136. Thus the left stabilizer element 578 and the right stabilizer element 560 work in tandem to limit the amount of vertical stress that can be exerted on the upper vibration dampening elements when the cleaning head assembly is lifted away from the floor surface 30. The bolt 562 defines and outside surface 576 that engages the inside surface of the apertures in the lower and upper motor mounting plates when the cleaning head assembly inadvertently is bumped into a wall, door frame or other obstacle. In this fashion the stabilizer element 560 limits the horizontal stress that can be exerted on the upper vibration dampening elements 138 and 140. Likewise the left stabilizer element 578, not shown, engages the apertures in the lower and upper motor mounting plates to limit horizontal stresses exerted on the upper vibration dampening elements 134 and 134. Therefore, the stabilizer elements 560 and 578 act in tandem to limit both vertical and horizontal stresses on the upper vibration dampening elements 134, 136, 138 and 140. A person skilled in the art will recognize that the stabilizer elements shown in FIG. 18-21 can be inverted and still achieve the purposes described above.

The flexible pad driver 124 can be produced as a single piece as shown in FIG. 10 or it can be produced as a matter of manufacturing convenience in multiple pieces as shown in FIG. 22. The multi-part flexible pad driver 308 in FIG. 22 is produced in three separate parts, the left wing 310, the right wing 312 and the central element 314. These three parts interlock and function as a single flexible component during operation of the cleaning head assembly 302. A first boss 333 and a second boss 335 extend from the left wing 310 through apertures in the central element 314 and have threaded receptacles to receive and engage the fifth lower vibration dampening element 332 and the sixth lower vibration dampening element 334, respectively. A third boss 337 and a fourth boss 339 extend from the right wing 312 through apertures in the central element 314 and have threaded receptacles to receive and engage the seventh lower vibration dampening element 336 and the eight lower vibration dampening element 338 as better seen in FIG. 26. A plurality of screws 316, 318, 320 and 322, better seen in FIGS. 23 and 25 connect the left and right wings to the central element. The upper vibration dampening elements and the lower vibration dampening elements, 324, 326, 328, 330, 332, 334 336 and 338 have an identical design and crossectional construction as the vibration dampening element 134 shown in FIG. 9.

Figure 23:
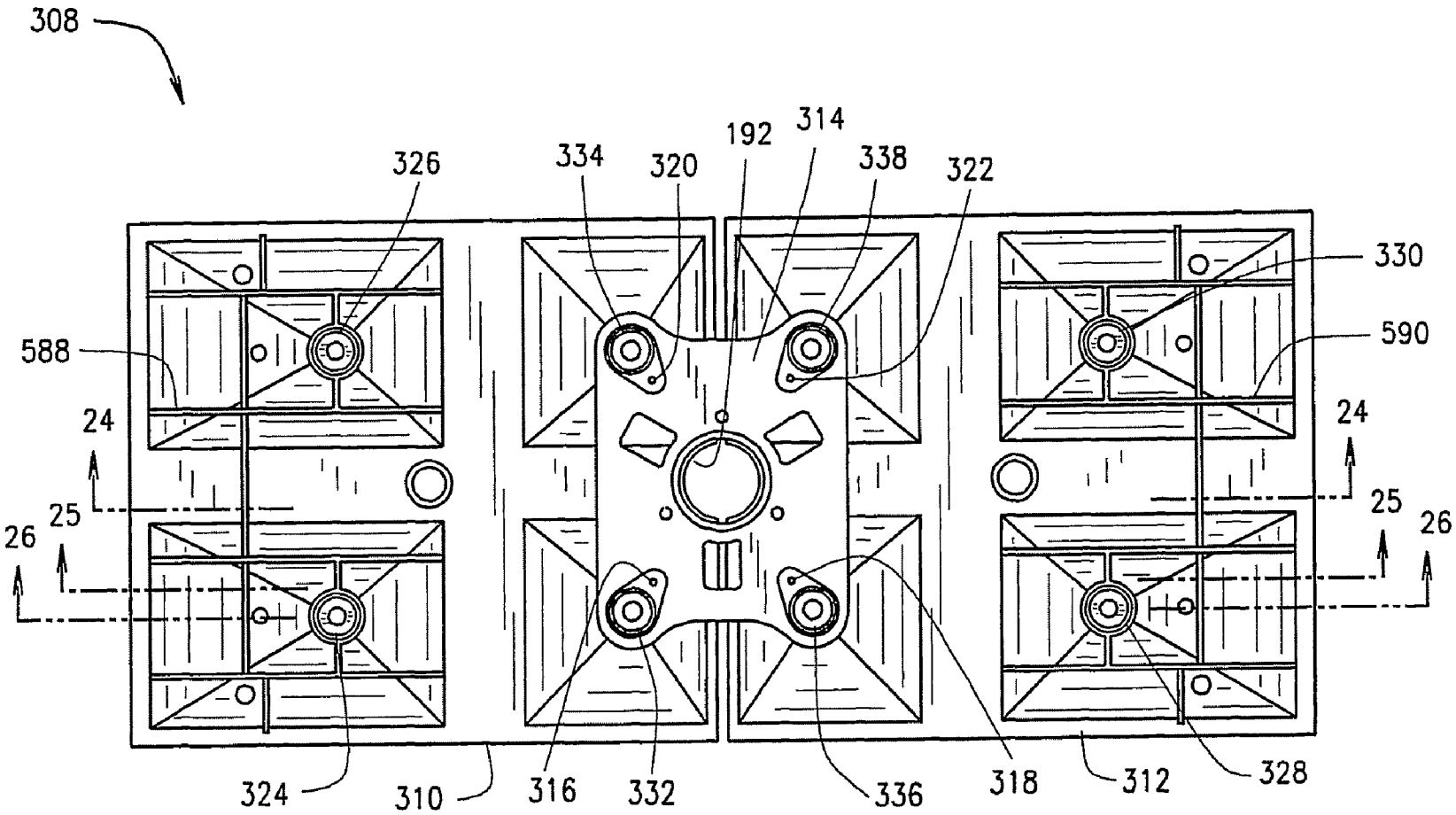
FIG. 23 is a top view of the multi-part flexible pad driver, assembled.

FIG. 23 is a assembled top view of the multi-part flexible pad driver 308. The central element 314 is connected to the left wing 310 by a plurality of screws 316 and 320 and the right wing 312 is connected to the central element 314 by a plurality of screws 318 and 322. These screws pass through the bottom of the wings and threadably engage the central element 314 as better seen in FIG. 25. The vibration dampening elements 332 and 334 threadably engage the left wing 310 and the vibration dampening element 336 and 338 threadably engage the right wing 312 as better seen in FIG. 26. A plurality of reinforcing webs such as 588 are formed in the left wing 310 and likewise a plurality of reinforcing webs such as 590 are formed in the right wing 312. The number and location of the reinforcing webs is a matter of manufacturing choice.

Figure 24:
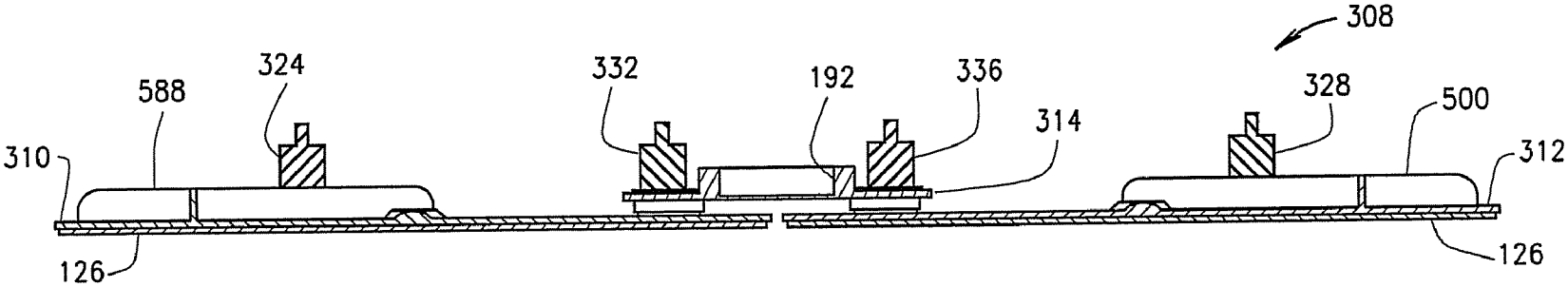
FIG. 24 is a section view of the assembled multi-part flexible pad driver along line 24-24 of FIG. 23.

FIG. 24 is a section view of the multi-part flexible pad driver 308 along the line 24-24 of FIG. 23. The multi-part flexible pad driver 308 is assembled with the lower vibration dampening elements 324 and 332 threadably engaging the left wing 310, and the lower vibration dampening element 328 and 336 threadably engaging the right wing 312.

FIG. 25 is a section view of the multi-part flexible pad driver 308 along the line 25-25 of FIG. 23. The multi-part flexible pad driver 308 is assembled with the lower vibration dampening elements 324 and 332 threadably engaging the left wing 310, and the lower vibration dampening element 328 and 336 threadably engaging the right wing 312. A screw 316 passes through the left wing 310 and threadably connects to the central element 314. A screw 318 passes through the right wing 312 and threadably connects to the central element 314. Other screws, 320 and 322, better seen in FIG. 23 also connect the left and right wings to the central element 314. In this fashion, the screws 316, 318, 320 and 322 interconnect the left wing, the right wing and central element which function as a single integrated flexible pad driver.

Figure 26:
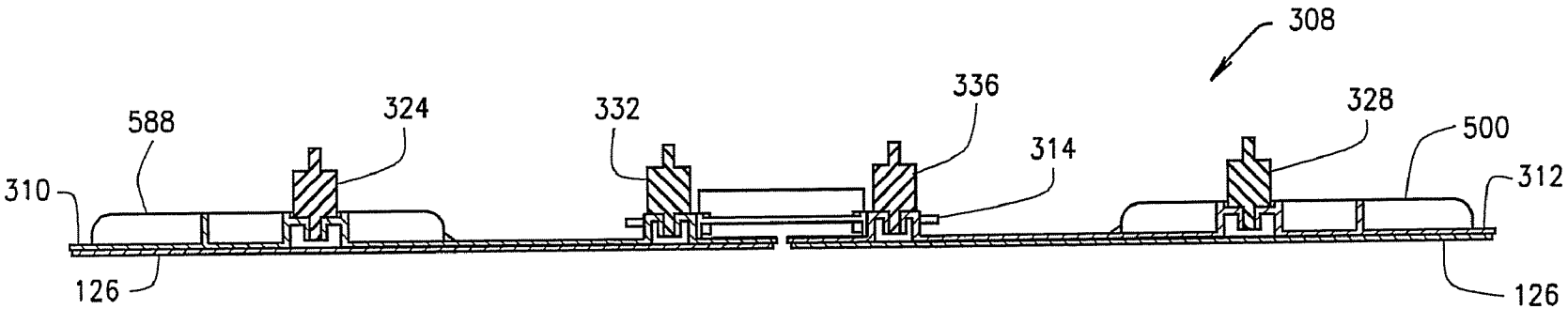
FIG. 26 is a section view of the assembled multi-part flexible pad driver along the line 26-26 of FIG. 23.

FIG. 26 is a section view of the multi-part flexible pad driver 308 along the line 26-26 of FIG. 23. The multi-part flexible pad driver 308 is assembled with the lower vibration dampening elements 324 and 338 threadably engaging the left wing 310. The multi-part flexible pad driver 308 is assembled with the lower vibration dampening elements 328 and 336 threadably engaging the right wing 312. As previously mentioned, the left and right wings are connected to the central element 314, by a plurality of screws, better seen in the prior figure.

FIG. 27 is a perspective view of a rider type scrubber 600 with the improved cleaning head assembly 302. A system and tanks for application of the cleaning solution 43 and pick-up of the dirty fluid with the squeegee 34 are present in the rider scrubber 600 similar to those used in the walk-behind scrubber 100 as will be understood by those skilled in the art.

The rider scrubber 600 includes a driver's seat 602 for the operator, not shown. The driver's seat is mounted on the body 604. A steering wheel 606 is mounted on an adjustable steering column 608 proximate the driver's seat. The steering column extends in a generally vertical orientation from the body and tilts back towards the driver's seat. Rotation of the steering wheel 606 controls the orientation of the front wheel 610. The adjustable steering column 608 may also be tilted away from the driver's seat to make it easier for the operator, not shown, to get into and out of the seat. The control panel 16 is mounted proximate the steering wheel to make it easier for the operator to see and use the panel. The improved cleaning head assembly 302 is located below the body between the front wheel 610 and the traction wheels 62 and 63, not shown. A traction motor, not shown, powers the traction wheels. When the traction wheels rotate, they move the scrubber 600 across the floor. The rider scrubber 600 can move forward and in reverse. The rider scrubber 600 includes a variable actuator, not shown to raise and lower the improved cleaning head assembly 302 between an upper position and a lower position, like cleaning head assembly used in the walk-behind scrubber 100. The variable actuator may also apply a downward load or head pressure on the improved cleaning head assembly, as previously discussed concerning the walk-behind scrubber 100. Many of the main components of the rider scrubber 600 are the same as the walk-behind scrubber 100 in FIG. 1, such as the solution tank, the recovery tank, batteries, vacuum motor, etc. For the sake of brevity these common components will not be repeated or discussed in detail. A cover 612 seals the solution tank, not shown.

The invention claimed is:

1. A floor scrubber to clean hard floor surfaces comprising:
- a solution tank to hold a cleaning solution;
- a squeegee to pick up a dirty fluid which is held in a recovery tank; and
- a cleaning head assembly comprising:
  - a pair of opposing lift brackets to raise and lower the cleaning head assembly;
  - a motor mounted on a motor mounting plate, the motor operatively connected to an eccentric cam;
  - a cleaning element removably connected to a flexible pad driver, the motor and eccentric cam imparting orbital movement to the flexible pad driver and the cleaning element; and at least one elongate stabilizer element positioned so as to limit the amount of vertical movement between at least one of the lift brackets and the motor mounting plate, which limits the elongation stresses on a plurality of upper vibration dampening elements coupled between the at least one of the lift brackets and the motor mounting plate;

wherein the at least one elongate stabilizer element and the upper vibration dampening elements are mounted to the at least one of the lift brackets at distinct, spaced-apart locations.

2. The apparatus of claim 1 wherein the at least one elongate stabilizer element has one end secured to one of the pair of opposing lift brackets and a free end extending through an aperture in the motor mounting plate.

3. A floor scrubber to clean hard floor surfaces comprising:

a solution tank to hold a cleaning solution;

a squeegee to pick up a dirty fluid which is held in a recovery tank; and a cleaning head assembly having:

a motor mounted on a motor mounting, the motor operatively connected to an eccentric cam;

a pair of opposing lift brackets each connected to the motor mounting plate by a plurality of upper vibration dampening elements;

a cleaning element removably connected to a flexible pad driver, the motor and eccentric cam imparting orbital movement to the flexible pad driver and the cleaning element; and an elongate stabilizer element positioned between each of the lift brackets and the motor mounting plate, the elongate stabilizer element and the upper vibration dampening elements being mounted to the lift bracket at distinct, spaced-apart locations;

wherein the elongate stabilizer element limits the amount of horizontal movement between the lift bracket and the motor mounting plate, which limits stress on the upper vibration dampening elements.

4. The apparatus of claim 3 wherein each of the elongate stabilizer elements has one end secured to one of the opposing lift brackets and a free end extending through an aperture in the motor mounting plate.

5. A cleaning head assembly for use with a floor scrubber to clean hard floor surfaces, the floor scrubber having a solution tank to hold a cleaning solution, a squeegee to pick up a dirty fluid which is held in a recovery tank, the cleaning head assembly comprising:

a motor mounted on a motor mounting plate, the motor operatively connected to an eccentric cam;

a pair of opposing lift brackets to raise and lower the cleaning head assembly;

at least one upper vibration dampening element coupled between each of the lift brackets and the motor mounting plate;

a cleaning element removably connected to a flexible pad driver, the motor and eccentric cam imparting orbital movement to the flexible pad driver and the cleaning element; and at least one elongate stabilizer element having one end coupled to one of the pair of opposing lift brackets and a free end extending through an aperture in the motor mounting plate to limit the amount of vertical and horizontal movement between the lift bracket and the motor mounting plate;

wherein the at least one elongate stabilizer element and the at least one upper vibration dampening element are mounted to the lift bracket at distinct, spaced-apart locations.

6. The apparatus of claim 5, wherein, the free end of the stabilizer element is larger in size than the aperture to allow the free end to engage the motor mounting plate when the lift bracket raises the cleaning element off the floor.

7. The apparatus of claim 5 wherein, the free end of the stabilizer element is generally t-shaped and larger than the aperture.

8. The apparatus of claim 5 wherein, the free end of the stabilizer element is larger in outside diameter than the inside diameter of the aperture to allow the free end to engage the motor mounting plate when the lift bracket raises the cleaning element off the floor, to limit the amount of vertical stretch in a plurality of upper vibration dampening elements.

9. The cleaning head assembly of claim 5 further including: an adjustable actuator to impart a variable amount of load on the flexible pad driver and the removable cleaning element.

10. The cleaning head assembly of claim 5 wherein the flexible pad driver is formed from plastic.

11. The cleaning head assembly of claim 5 further including tool free attaching means to attach the removable cleaning element to the flexible pad driver.

12. A cleaning head assembly for use with a floor scrubber to clean hard floor surfaces, the floor scrubber having, a solution tank to hold a cleaning solution, a squeegee to pick up a dirty fluid which is held in a recovery tank, the cleaning head assembly comprising:

a motor mounted on a motor mounting plate, the motor operatively connected to an eccentric cam;

a pair of opposing lift brackets to raise and lower the cleaning head assembly;

a cleaning element removably connected to a flexible pad driver, the motor and eccentric cam imparting orbital movement to the flexible pad driver and the cleaning element;

a plurality of upper vibration dampening elements connecting the lift brackets to the motor mounting plate; and a pair of elongate stabilizer elements each having one end secured to one of the pair of opposing lift brackets, and each having a free end extending through an aperture in the motor mounting plate to limit the amount of vertical movement between the lift bracket and the motor mounting plate which limits elongation stress on the upper vibration dampening elements;

wherein the elongate stabilizer elements and the upper vibration dampening elements are mounted to the lift brackets at distinct, spaced-apart locations.

* * * * *

UNITED STATES PATENT AND TRADEMARK OFFICE

CERTIFICATE OF CORRECTION

PATENT NO. : 8,234,749 B2
APPLICATION NO. : 11/927529
DATED : August 7, 2012
INVENTOR(S) : Mitchell et al.

It is certified that error appears in the above-identified patent and that said Letters Patent is hereby corrected as shown below:

On the face page, in column 2, under "Other Publications", line 1, delete "F a.S.T." and insert --"Fa.S.T.--, therefor On the face page, in column 2, under "Other Publications", line 1, after "Handout", insert --"--, therefor On page 2, column 1, under "Other Publications", line 1, delete "F.a.S.T" and insert --"Fa.S.T.--, therefor On page 2, column 1, under "Other Publications", line 1, after "Technology", insert --"--, therefor On page 2, column 1, under "Other Publications", line 3, before "Clarke", insert --"--, therefor On page 2, column 1, under "Other Publications", line 4, after "Sanders", insert --"--, therefor On page 2, column 2, under "Other Publications", line 1, before "Clarke", insert --"--, therefor On page 2, column 2, under "Other Publications", line 2, after "18DC", insert --"--, therefor On page 2, column 2, under "Other Publications", line 4, before "Clarke", insert --"--, therefor On page 2, column 2, under "Other Publications", line 4, after "Catalog", insert --"--, therefor On page 2, column 2, under "Other Publications", line 8, before "Clarke", insert --"--, therefor On page 2, column 2, under "Other Publications", line 9, after "18SP", insert --"--, therefor On page 2, column 2, under "Other Publications", line 12, before "Clarke", insert --"--, therefor Signed and Sealed this
Twelfth Day of February, 2013

Teresa Stanek Rea
*Acting Director of the United States Patent and Trademark Office*

On page 2, column 2, under “Other Publications”, line 12, delete “Brochure, 4 pgs.” and insert --Brochure”, 4 pgs.,--, therefor On page 2, column 2, under “Other Publications”, line 14, before “Clarke”, insert --“--, therefor On page 2, column 2, under “Other Publications”, line 16, after “Manual”, insert --”--, therefor On page 2, column 2, under “Other Publications”, line 18, before “Clarke”, insert --“--, therefor On page 2, column 2, under “Other Publications”, line 18-19, after “S20/L20”, insert --”--, therefor On page 2, column 2, under “Other Publications”, line 21, before “Clarke”, insert --“--, therefor On page 2, column 2, under “Other Publications”, line 22, after “L2426”, insert --”--, therefor On page 2, column 2, under “Other Publications”, line 24, before “Clarke”, insert --“--, therefor On page 2, column 2, under “Other Publications”, line 25, after “S38XP”, insert --”--, therefor On page 2, column 2, under “Other Publications”, line 27, before “Clarke”, insert --“--, therefor On page 2, column 2, under “Other Publications”, line 28, after “S38/L381”, insert --”--, therefor On page 2, column 2, under “Other Publications”, line 31, before “Clarke”, insert --“--, therefor On page 2, column 2, under “Other Publications”, line 32, after “S30/L30”, insert --”--, therefor On page 2, column 2, under “Other Publications”, line 34, before “Allway”, insert --“--, therefor On page 2, column 2, under “Other Publications”, line 25, after “Presentation”, insert --”--, therefor In column 25, line 20, in claim 3 after “mounting”, insert --plate--, therefor